US007187896B2

(12) United States Patent
Fujisawa et al.

(10) Patent No.: US 7,187,896 B2
(45) Date of Patent: Mar. 6, 2007

(54) FIXING DEVICE

(75) Inventors: Kazutoshi Fujisawa, Nagano (JP); Makoto Sato, Nagano (JP); Katsuhito Gomi, Nagano (JP); Naoyuki Okumura, Nagano (JP); Hideki Okada, Nagano (JP); Shuhei Mori, Nagano (JP); Shinichi Kamoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/463,248

(22) Filed: Aug. 8, 2006

(65) Prior Publication Data

US 2006/0291917 A1 Dec. 28, 2006

Related U.S. Application Data

(62) Division of application No. 10/703,083, filed on Nov. 7, 2003.

(30) Foreign Application Priority Data

| | | |
|---|---|---|
| Nov. 7, 2002 | (JP) | P2002-323497 |
| Nov. 7, 2002 | (JP) | P2002-323498 |
| Nov. 7, 2002 | (JP) | P2002-323499 |
| Jan. 10, 2003 | (JP) | P2003-003962 |
| Jan. 30, 2003 | (JP) | P2003-021967 |
| Oct. 10, 2003 | (JP) | P2003-351563 |

(51) Int. Cl.
*G03G 15/20* (2006.01)

(52) U.S. Cl. ..... 399/323

(58) Field of Classification Search ..... 399/405, 399/406, 322, 323

See application file for complete search history.

(56) References Cited

U.S. PATENT DOCUMENTS

| | | | | |
|---|---|---|---|---|
| 5,245,395 | A | 9/1993 | Pawlik et al. | |
| 5,289,244 | A * | 2/1994 | Takano | 399/322 |
| 5,532,810 | A | 7/1996 | Cahill | |
| 6,298,214 | B1 | 10/2001 | Koga | |
| 6,564,030 | B2 | 5/2003 | Baughman et al. | |
| 6,678,496 | B1 | 1/2004 | Aslam et al. | |
| 6,785,503 | B2 | 8/2004 | Kuo et al. | |
| 6,963,717 | B1 | 11/2005 | Klimley et al. | |
| 2001/0016134 | A1 | 8/2001 | Park | |
| 2001/0036377 | A1 | 11/2001 | Tsyjihara | |

FOREIGN PATENT DOCUMENTS

| | | | |
|---|---|---|---|
| JP | 59219768 | A | 12/1984 |
| JP | 02306279 | A * | 12/1990 |
| JP | 03164777 | A * | 7/1991 |

(Continued)

*Primary Examiner*—Susan Lee
(74) *Attorney, Agent, or Firm*—Sughrue Mion, PLLC

(57) ABSTRACT

In a fixing device incorporated in an image forming apparatus and operable to fix a toner image on a recording medium, a first rotative member and a second rotative member form a nip portion therebetween, at which the toner image is fixed on the recording medium. A separator separates the recording medium, which has been passed through the nip portion, from one of the first rotative member and the second rotative member. The separator is provided with a first guide face extending in a first direction to guide the separated recording medium to an inlet of a subsequent stage of the image forming apparatus. The first guide face is provided with a rib extending in the first direction.

2 Claims, 37 Drawing Sheets

FOREIGN PATENT DOCUMENTS

| | | | | |
|---|---|---|---|---|
| JP | 03225385 | A | | 10/1991 |
| JP | 07044045 | A | | 2/1995 |
| JP | 08171302 | A | * | 7/1996 |
| JP | 11-184300 | A | | 7/1999 |
| JP | 2002-287555 | A | | 10/2002 |

* cited by examiner

FIG. 32A
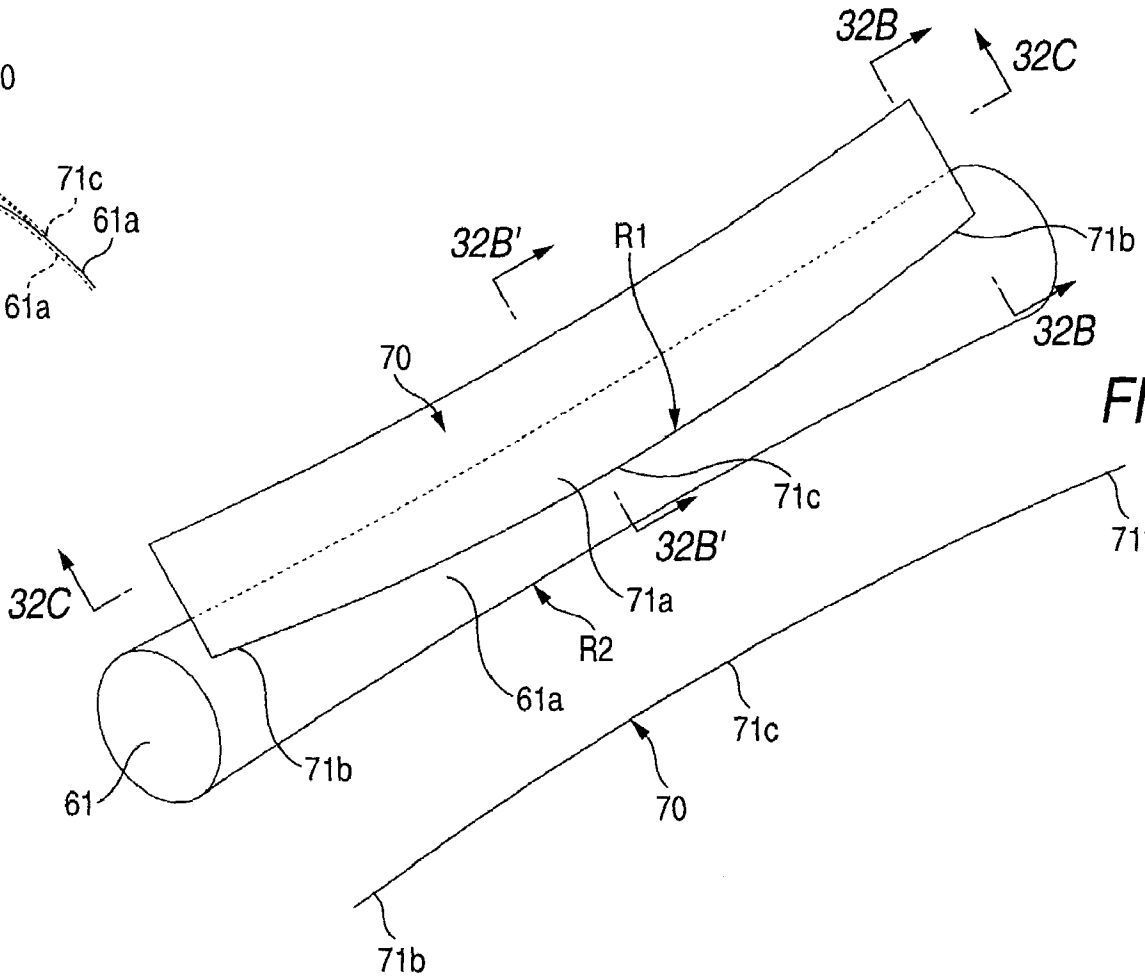
FIG. 32B
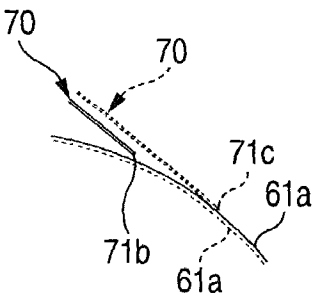
FIG. 32C

FIG. 33A
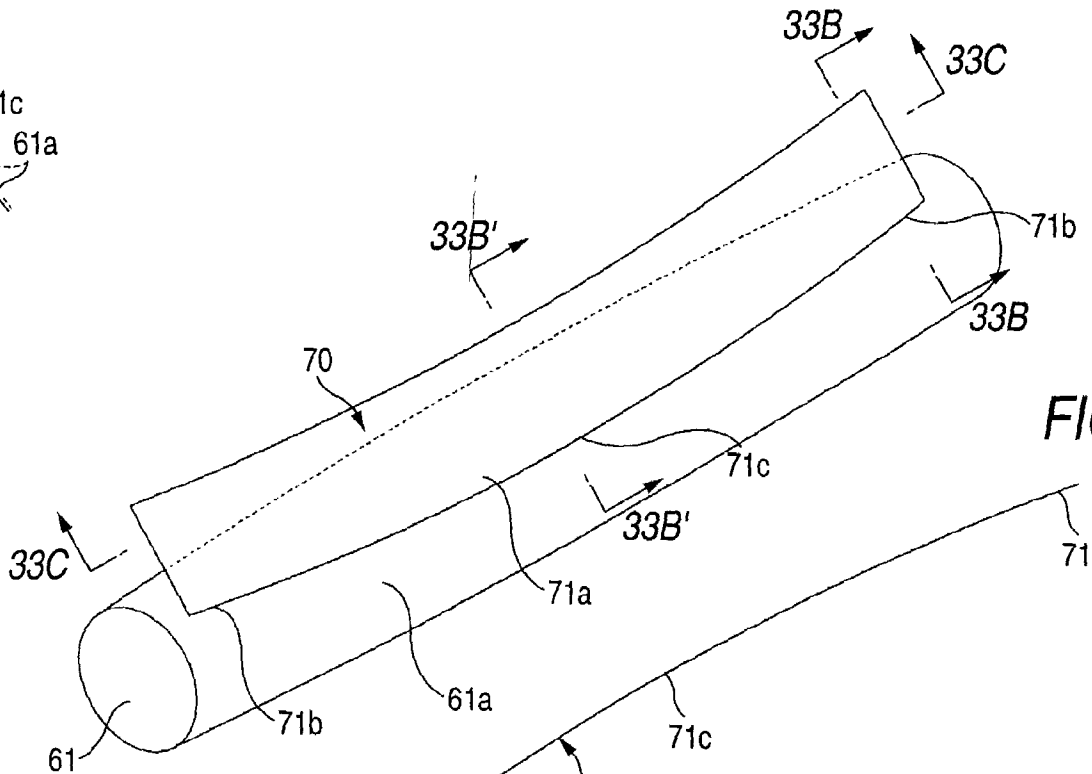
FIG. 33C
FIG. 33B
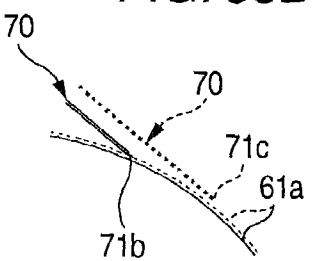

34B
34C
34B'
70
70b
70c
G
61a
71a
71b
71c
61

FIXING DEVICE

CROSS-REFERENCE TO RELATED APPLICATIONS

This is a divisional of U.S. application Ser. No. 10/703,083, filed Nov. 7, 2003, which is incorporated herein by reference in its entirety.

BACKGROUND OF THE INVENTION

The present invention relates to a fixing device incorporated in an image forming apparatus such as a printer, a facsimile, a copier for forming an image by using an electrophotography technology. Particularly, the invention relates to a technology of improving a sheet separator incorporated in the fixing device.

Generally, an image forming apparatus using an electrophotography technology comprises a photosensitive member having a photosensitive layer on an outer peripheral face thereof, a charger for uniformly charging the outer peripheral face of the photosensitive member, an exposer for forming an electrostatic latent image by selectively exposing the outer peripheral face uniformly charged by the charger, a developing device for forming a visible image (toner image) by providing a toner which is a developing agent to the electrostatic latent image formed by the exposer, a transferring device for transferring the toner image developed by the developing device onto a sheet-shaped recording medium (paper or the like), and a fixing device for fixing the toner image on the recording medium.

The fixing device comprises a fixing member driven to rotate (for example, a fixing roller or a fixing belt having a heat source) and a pressing member (for example, a pressing roller) rotated by being brought into press contact with the fixing member, so that the toner is melted to fix on the recording medium by heating the recording medium while passing the recording medium at a portion of bringing the fixing member and the pressing member into press contact with each other (a nip portion).

Further, a face of the recording medium formed with the toner image is liable to paste on the fixing member (also on the pressing member when images are formed on both faces of the recording medium) by adhering property of the toner. Accordingly, at least one of the fixing member and the pressing member is provided with a sheet separator for separating and guiding the recording medium, which has been passed through the nip portion, from a surface of the member.

Japanese Patent Publication No. 11-184300A (cf., descriptions [0018], [0022]–[0024], FIGS. 1 and 2) discloses a fixing device comprising: a fixing roller driven to rotate; a pressing roller rotated by being brought into press contact with the fixing roller; a separator provided at the fixing roller for separating and guiding a sheet-shaped recording medium passing a nip portion of the fixing roller and the pressing roller from a surface of the fixing roller; and a supporter for supporting the separator.

An upstream end of a guide face of the separator is brought into contact with the surface of the fixing roller, and a guide face of the supporter is bent relative to a downstream end of the guide face in a direction of moving the recording medium.

Further, the separator is constituted by a base member comprised of heat resistant resin or metal and a fluororesin layer provided at a surface of the base member. The supporter is constituted by metal.

According to the above-described fixing device, when the recording medium is guided by the guide face to a discharge roller or the like disposed at a later stage after passing the nip portion of the fixing member and the pressing member, there is a case in which the leading end of the recording medium collides on the discharge roller or the like. Therefore, there is a case in which the recording medium is temporarily bent significantly between the nip portion and the discharge roller or the like, so that a toner adhering face of the recording medium is brought into press contact with the guide face to paste thereon to bring about paper jam (clogging of recording medium).

In the above fixing device, since a downstream end of the guide face of the supporter and the downstream end of the separator are both remote from an inlet of the discharge roller pair, when the recording medium passes the nip portion of the fixing member and the pressing member and is guided by the guide faces to the discharge roller pair disposed at the later stage, the leading end of the recording medium tend to collide on the discharge roller or the like, so that paper jam (clogging of recording medium) is liable to be brought about.

In order to resolve the problem, both of the downstream end of the guide face of the supporter and the downstream end of the guide face of the separator may be arranged at a vicinity of an inlet of the discharge roller pair. However, in this case, a toner adhering face of the recording medium is pasted on the separator or the supporter to thereby pose a problem of still bringing about paper jam.

Japanese Patent Publication No. 2002-287555A discloses a fixing device wherein the separator is arranged adjacent to the fixing member and shaped so as to be identical with the shape of an outlet of the nip portion of the fixing member and the pressing member to avoid troubles due to concentration of the press contact force between the upstream end of the separator and the recording medium.

Specifically, in a case where the fixing member has an inverse crown shape (a diameter of both longitudinal end portions is larger than a diameter of a longitudinal center portion), the upstream end of the separator is convex to the upstream of the medium transporting direction. On the other hand, in a case where the fixing member has a crown shape (a diameter of both longitudinal end portions is smaller than a diameter of a longitudinal center portion), the upstream end of the separator is concaved to the downstream of the medium transporting direction.

The recording medium passing the nip portion of the fixing member and the pressing member does not necessarily pass therethrough in a state where the leading edge of the recording medium is in parallel with an axis line of the fixing member but normally passes therethrough in a state where the leading edge is skewed thereto although the amount of skewing is small.

In the latter case, the leading edge of the recording medium is actually separated from a right side or a left side thereof. In the former case, since the entire leading edge of the recording medium collides with the upstream end of the separator at the same time, large impact is temporarily acted to the separator and the recording medium.

Therefore, the fixing device poses a problem that operation of separating the recording medium is not stabilized, so that a problem that paper jam (clogging of recording medium) is liable to be brought about is posed.

SUMMARY OF THE INVENTION

It is therefore an object of the invention to provide a fixing device capable of stabilizing the separating operation of the separator to avoid the above described paper jam.

In order to achieve the above object, according to the invention, there is provided a fixing device, incorporated in an image forming apparatus and operable to fix a toner image on a recording medium, comprising:

a first rotative member and a second rotative member, forming a nip portion therebetween, at which the toner image is fixed on the recording medium; and a separator, which separates the recording medium, which has been passed through the nip portion, from one of the first rotative member and the second rotative member, the separator comprising a first guide face extending in a first direction to guide the separated recording medium to an inlet of a subsequent stage of the image forming apparatus, the first guide face provided with a rib extending in the first direction.

Preferably, the rib is situated at a position closer to one of the first rotative member and the second rotative member than a line connecting the nip portion and the inlet.

Preferably, the rib is situated at a position closer to one of the first rotative member and the second rotative member than a line connecting the inlet and an upstream end of the separator relative to a transporting direction of the recording medium.

Preferably, the rib is situated at a position closer to one of the first rotative member and the second rotative member than a line connecting an upstream end and a downstream end of the first guide face relative to a transporting direction of the recording medium.

It is preferable that: the separator further comprises a second guide face disposed in the vicinity of one of the first rotative member and the second rotative member to separate the recording medium therefrom; and the second guide face extends in a second direction which is different from the first direction and continues to the first guide face.

Preferably, the separator comprises a first layer formed with a through hole and defining the first guide face, and a second layer formed with the rib, which are laminated such that the rib is protruded from the through hole.

According to the invention, there is also provided a fixing device, incorporated in an image forming apparatus and operable to fix a toner image on a recording medium, comprising:

a first rotative member and a second rotative member, forming a nip portion therebetween, at which the toner image is fixed on the recording medium; and a separator, comprising:

a first portion disposed in the vicinity of one of the first rotative member and the second rotative member to separate the recording medium, which has been passed through the nip portion, from one of the first rotative member and the second rotative member, the first portion extending in a first direction to guide the separated recording medium therealong; and a second portion continued from the first portion and including a plurality of sections each extending in a direction which is different from the first direction to guide the recording medium to an inlet of a subsequent stage of the image forming apparatus, wherein a downstream end of the second portion relative to a transporting direction of the recording medium is disposed in the vicinity of the inlet.

According to the invention, there is also provided a fixing device, incorporated in an image forming apparatus and operable to fix a toner image on a recording medium, comprising:

a first rotative member and a second rotative member, forming a nip portion therebetween, at which the toner image is fixed on the recording medium; and a separator, having an edge portion which separates the recording medium, which has been passed through the nip portion, from one of the first rotative member and the second rotative member, the separator extending in a first direction which is perpendicular to a transporting direction of the recording medium, wherein:

the edge portion is convex toward an upstream side of the transporting direction; and the separator is curved such that both end portions thereof in the first direction are made closer to one of the first rotative member and the second rotative member than a center portion thereof in the first direction.

BRIEF DESCRIPTION OF THE DRAWINGS

The above objects and advantages of the present invention will become more apparent by describing in detail preferred exemplary embodiments thereof with reference to the accompanying drawings, wherein:

FIG. 32A is a perspective view of a first modified example of the fixing device of FIG. 31A;

FIG. 32B is view showing sections taken along a line 32B—32B (solid line) and taken along a line 32B'—32B' (dashed line) in FIG. 32A;

FIG. 32C is a section view taken along a line 32C—32C in FIG. 32A;

FIG. 33A is a perspective view of a second modified example of the fixing device of FIG. 31A;

FIG. 33B is view showing sections taken along a line 33B—33B (solid line) and taken along a line 33B'—33B' (dashed line) in FIG. 33A;

FIG. 33C is a section view taken along a line 33C—33C in FIG. 33A;

DETAILED DESCRIPTION OF THE INVENTION

Preferred embodiments of the invention will be explained below with reference to the accompanying drawings.

Figure 1:
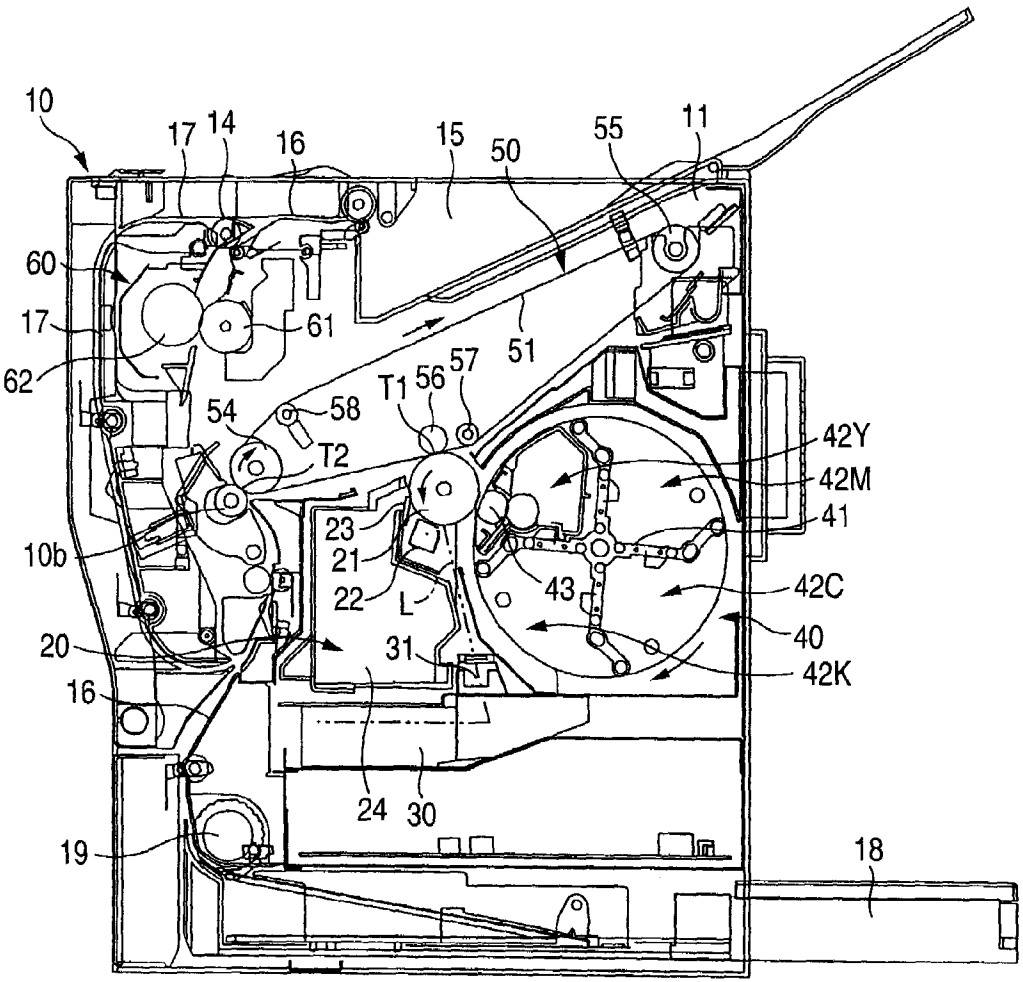
FIG. 1 is an sectional side view showing an inner structure of an image forming apparatus incorporating a fixing device of the invention.

FIG. 1 shows an image forming apparatus incorporating a fixing device according to a first embodiment of the invention.

The image forming apparatus is a color image forming apparatus capable of forming full color images on both faces of a recording sheet (recording medium) of A3 size and is provided with: a case 10, an image carrier 20, an exposer 30, a developing device 40, an intermediate transferring device 50 and a fixing device 60, which are disposed inside of the case 10.

The case 10 is provided with a frame, not illustrated, of an apparatus main body and the respective units are attached to the frame.

The image carrier 20 comprises a photosensitive member (image carrier) 21 having a photosensitive layer at an outer peripheral face thereof and a charger (scorotron charger) 22 for uniformly charging the outer peripheral face of the photosensitive member 21. An electrostatic latent image is formed by selectively exposing the outer peripheral face of the photosensitive member 21 charged uniformly by the charger 22 by laser beam L from the exposer 30. A visible image (toner image) is formed by providing toner (a developing agent) to the electrostatic latent image by the developing device 40, the toner image is primarily transferred to an intermediate transferring belt 51 of the intermediate transferring device 50 by a primary transfer position T1, and secondarily transferred to the recording sheet at a secondary transfer position T2.

The image carrier 20 is provided with: a cleaner (cleaning blade) 23 for removing the toner remaining on a surface of the photosensitive member 21 after the primary transfer; and a waste toner container 24 for containing the waste toner removed by the cleaner 23.

Inside of the case 10 is provided with a transporting path 16 for transporting the recording sheet formed with an image on one face thereof at the secondary transfer position T2 to a sheet discharging portion (discharging tray) 15 and a return path 17 for switching back the recording sheet carried to the sheet discharging portion 15 by the transporting path 16 to return to the secondary transfer position T2 to form an image also on other face thereof.

A lower portion of the case 10 is provided with a sheet feeding tray 18 for accommodating stacked recording sheets and a feeding roller 19 for feeding the sheets to the secondary transfer position T2 one by one.

The developing device 40 is a rotary developing device wherein a plurality of developer cartridges respectively containing toners are detachably mounted in a main body 41. According to the embodiment, a developer cartridge 42Y for yellow, a developer cartridge 42M for magenta, a developer cartridge 42C for cyan and a developer cartridge 42K for black are provided (in the drawing, only the developer cartridge 42Y for yellow is representatively shown) and a surface of the photosensitive member 21 can selectively be developed by selectively bringing a developing roller 43 into contact with the photosensitive member 21 by rotating the main body 41 by a pitch of 90 degrees in an arrow mark direction.

The exposer 30 irradiates a laser beam L to the photosensitive member 21 from an exposing window 31 constituted by a plate glass or the like.

The intermediate transferring device 50 is provided with a unit frame (not illustrated), the intermediate transfer belt 51 suspended and circulated in an arrow mark direction by a drive roller 54 supported by the unit frame, a driven roller 55, a primary transferring roller 56, a guide roller 57 for stabilizing the state of the belt 51 at the primary transfer position T1, and a tension roller 58. The primary transfer position T1 is formed between the photosensitive member 21 and the primary transferring roller 56 and the secondary transfer position T2 is formed at a portion for bringing the drive roller 54 and a secondary transferring roller 10*b* provided on the main body side into press contact with each other.

The second transferring roller 10*b* can be contacted to and separated from the drive roller 54 (and therefore, the intermediate transferring belt 51) and the secondary transfer position T2 is formed when the both members are brought into contact with each other.

Therefore, when a color image is formed, the color image is formed by overlapping a plurality of colors of toner images on the intermediate transferring belt 51 in a state where the secondary transferring roller 10*b* is separated from the intermediate transferring belt 51, thereafter, the secondary transferring roller 10*b* is brought into contact with the intermediate transferring belt 51 and the color image (toner image) is transferred onto the recording sheet by supplying the sheet to the secondary transfer position T2.

Sheet transferred with the toner image passes through the fixing device 60 so that the toner is melted and fixed on the recoding sheet. Then the recording sheet is discharged to the discharging tray 15.

Figure 2:
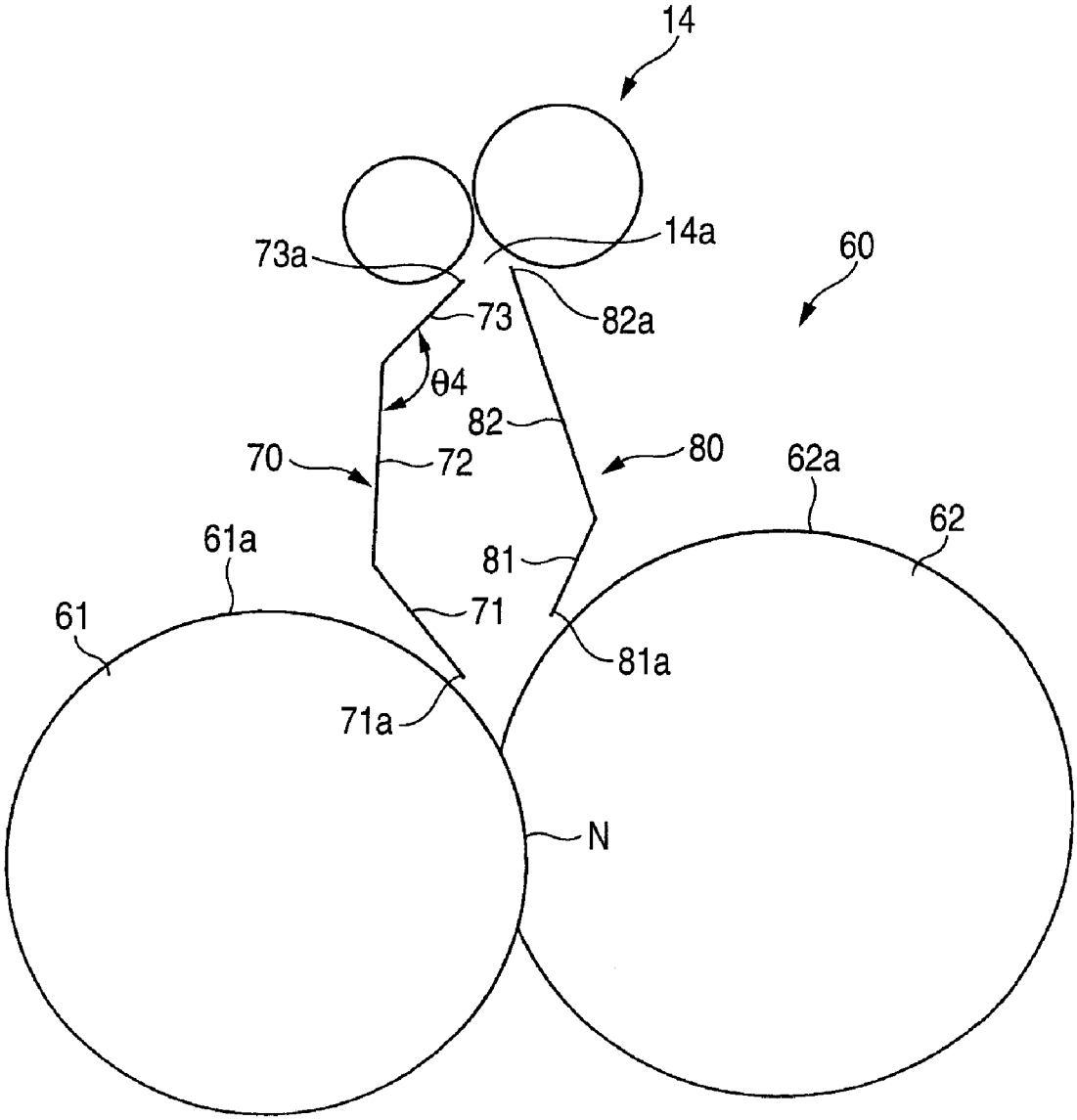
FIG. 2 is an enlarged side view showing an essential portion of a fixing device according to a first embodiment of the invention.

As shown in FIG. 2, the fixing device 60 of the embodiment comprises: a fixing roller 61 driven to rotate by a not shown driving mechanism; a pressing roller 62 rotated by being brought into press contact with the fixing roller 61; a first separator 70 and a second separator 80 for separating and guiding a sheet-shaped recording medium P (refer to FIG. 12) passing a nip portion N of the fixing roller 61 and the pressing roller 62 from a surface of the fixing roller 61 or the pressing roller 62. A downstream end 82*a* of the second separator 80 is arranged at a vicinity of an inlet 14*a* of the discharging roller pair 14.

The first separator 70 comprises: a first guide face 71 in which an upstream edge 71*a* is proximate to a surface 61*a* of the fixing roller 61; a second guide face 72 continuous to the first guide face 71 on the downstream side of the transporting direction of the recording medium P, and bent relative to the first guide face 71; and a third guide face 73 continuous to the second guide face 72 on the downstream side in the transporting direction the recording medium P, and bent relative to the second guide face 72. The second guide face 72 is provided with a rib 74 extended in the transporting direction the recording medium P. A downstream end 73*a* of the third guide face 73 is arranged at a vicinity of the inlet 14*a* of the discharging roller pair 14.

The guide face of the first separator 70 may be constituted to further including guide faces of a fourth guide face continuous to a downstream side in the transporting direction of the recording medium P of the third guide face 73 and bent relative to the third guide face 73. In this case, a downstream end of a final guide face is arranged at a vicinity of the inlet 14*a* of the discharging roller pair 14 arranged at a later stage.

According to the embodiment, since toner images are formed on both faces of the recording medium P, heat sources are provided not only at inside of the fixing roller 61 but also at inside of the pressing roller 62. Therefore, the second separator 80 is provided also for the pressing roller 62, however, in a case where a toner image is formed only on one face of the recording medium P, the separator is provided only for a member provided with the heat source.

Hardness of the fixing roller 61 is higher than hardness of the pressing roller 62 and therefore, as shown by FIG. 2, the nip portion N of the two rollers is formed by a shape recessed to the side of the pressing roller 62.

The fixing device 60 is constituted as an oilless fixing device in which oil is not coated on the fixing roller 61 and the pressing roller 62.

The first separator 70 is constituted by bending one sheet of a metal plate, thereby, the first through the third guide faces 71 through 73 are formed. The guide faces of the first separator 70 are coated with fluororesin or the like excellent in separating performance with respect to the toner.

The second separator 80 comprises: a first guide face 81 in which an upstream edge 81*a* is proximate to a surface 62*a* of the pressing roller 62; and a second guide face 82 continuous to the first guide face 81 on the downstream side in the transporting direction the recording medium P, and bent relative to the first guide face 81. The second guide face 82 is provided with ribs 84 and 84' extended in the transporting direction the recording medium P. The downstream end 82*a* of the second guide face 82 is arranged to be proximate to the inlet 14*a* of the discharging roller pair 14.

Similar to the first separator 70, the second separator 80 is constituted by folding to bend one sheet of a metal plate, thereby, the first and the second guide faces 81 and 82 are formed. The guide faces of the second separator 80 are coated with fluororesin or the like excellent in separating performance with respect to the toner.

The second separator 80 is supported by a not-shown frame of the fixing device 60 by a not-shown support member.

In order to make easy to understand the advantages attained by the invention, explanations will be given of a case where the first separator 70 is not bent (first comparative example: FIGS. 3A through 5), a case where only an upstream portion of the first separator 70 is bent (second comparative example: FIGS. 6A through 8), and a case where only a downstream portion of the first separator 70 is bent (third comparative example: FIGS. 9A through 11).

Figure 3A:
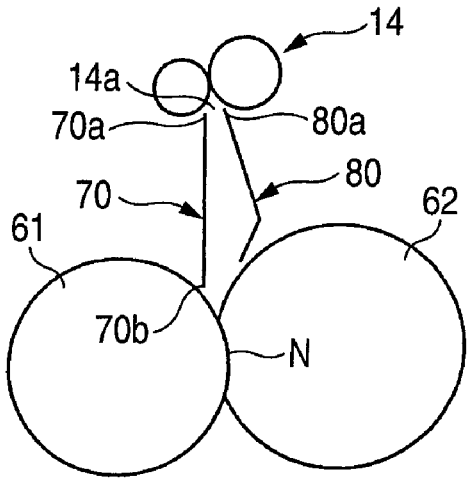
FIGS. 3A through 5 are views for explaining operations of a fixing device according to a first comparative example.

FIG. 3A shows the first comparative example in which a downstream end 70*a* of the first separator 70 and a downstream end 80*a* of the second separator 80 are arranged at a vicinity of the inlet 14*a* of the discharging roller pair 14 and the first separator 70 is not bent.

Figure 3B:
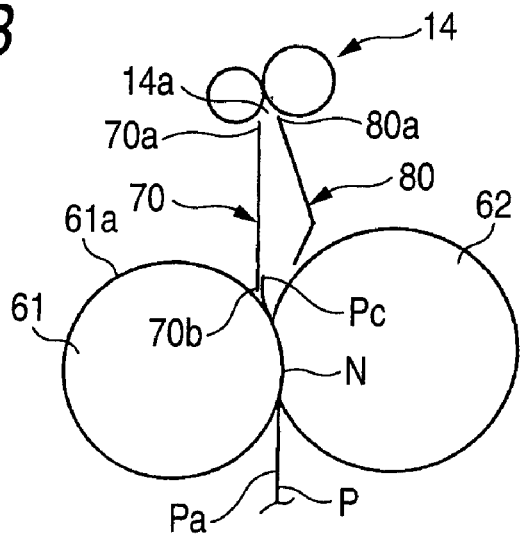
Figure 3C:
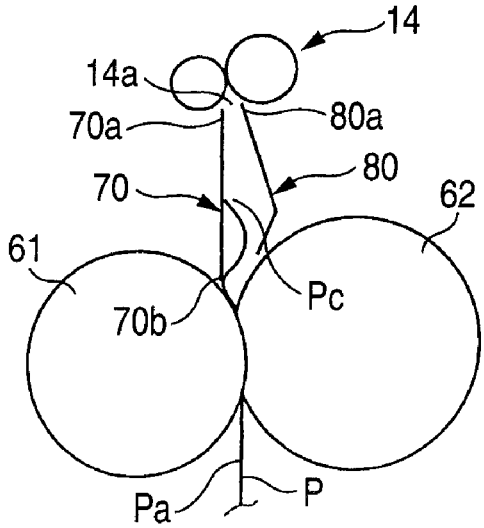

As shown in FIG. 3B, when the recording medium P formed with a toner image (not illustrated) on one face Pa is supplied, a leading end Pc of the recording medium P passes the nip portion N of the fixing roller 61 and the pressing roller 62 and reaches an upstream edge 70*b* of the first separator 70, the recording medium P is separated from the surface 61*a* of the fixing roller 61 by being scooped up by the upstream edge 70*b* of the first separator 70. Normally, the front end portion of the recording medium P is constituted by a non image region (region without toner) and liable to leave from the surface 61*a* of the fixing roller 61 and therefore, separating operation of the recording medium P is excellently achieved.

Thereafter, the leading end Pc of the recording medium P is guided by the first separator 70 and directed to the discharging roller pair 14 as shown in FIGS. 3C through 4C, however, the recording medium P passing the nip portion N is bent (curled) in a direction the same as that of the shape of the nip portion N. Further, even when the shape of the nip portion N is flat, in the case where temperature of the fixing roller 61 is higher than that of the pressing roller 62, the recording medium P is curved as illustrated since moisture is more evaporated on the side of the face in contact with the fixing roller 61.

Figure 4A:
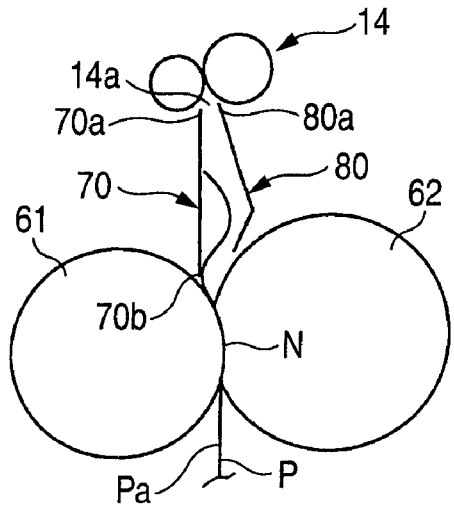
Figure 4B:
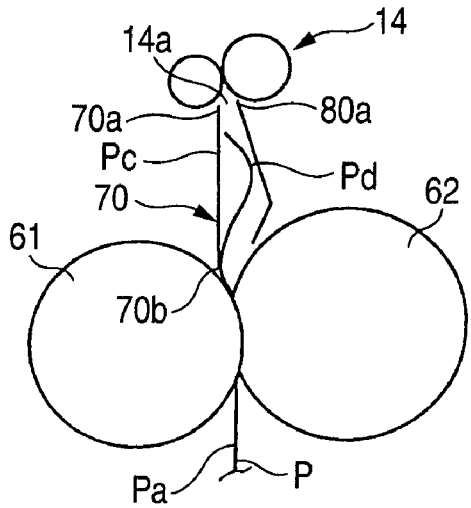
Figure 4C:
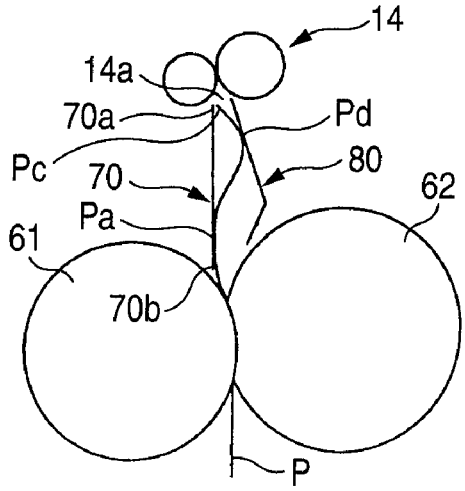
Figure 5:
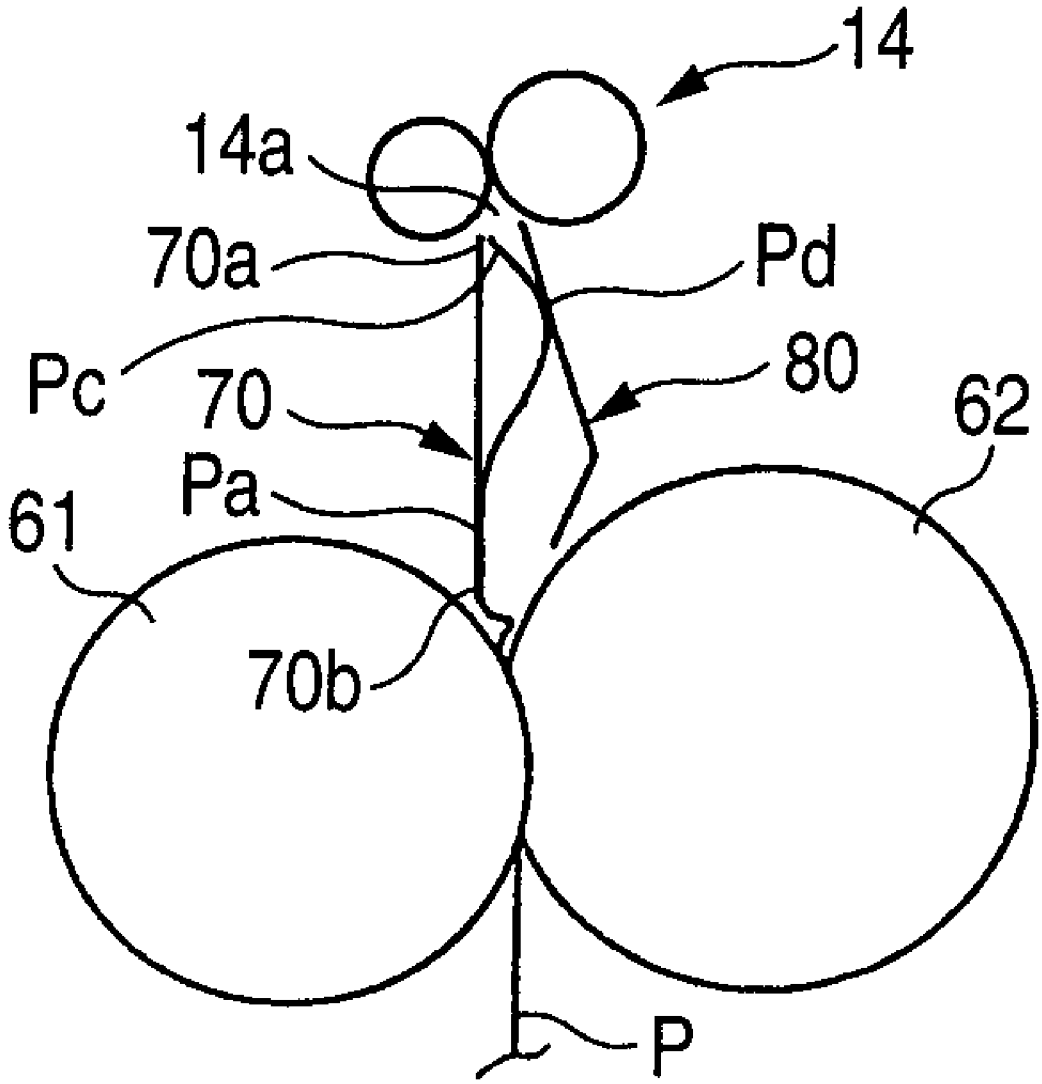

Therefore, as the recording medium P proceeds to discharging roller pair 14, as shown in FIG. 4C, when a top portion Pd of the bent portion of the recording medium P is brought into contact with the second separator 80, the recording medium P is pressed by the second separator 80 and a toner adhering face Pa thereof is brought into press contact with the first separator 70, the toner adhering face Pa is liable to paste on the first separator 70 and paper jam (clogging of recording medium P) is liable to be brought about as shown in FIG. 5.

Particularly, in the case of an oilless fixing device wherein the separating member is made of metal, temperature of the first separator 70 is elevated by heat from the fixing roller 61 and/or the pressing roller 62 and therefore, the toner adhering face Pa is liable to paste thereon.

Figure 6A:
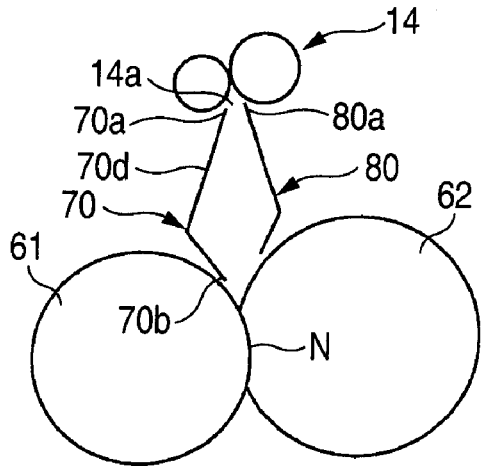
FIGS. 6A through 8 are views for explaining operations of a fixing device according to a second comparative example.

FIG. 6A shows the second comparative example in which the downstream end 70*a* of the first separator 70 and the downstream end 80*a* of the second separator 80 are arranged at a vicinity of the inlet 14*a* of the discharging roller pair 14 and only the upstream portion of the first separator 70 is bent.

Figure 6B:
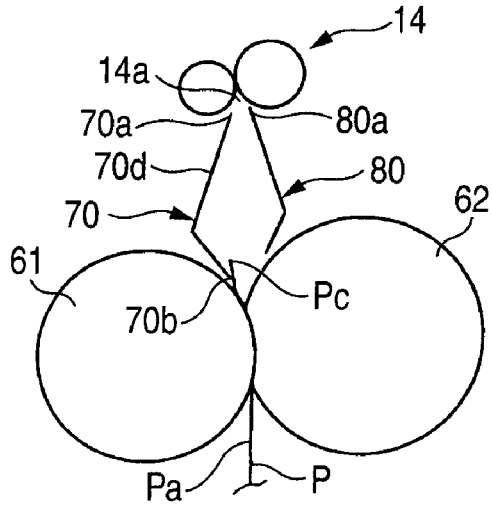
Figure 6C:
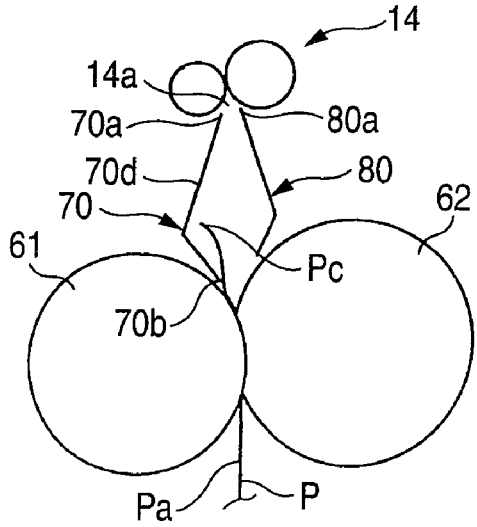

As shown in FIG. 6B, when the recording medium P formed with a toner image (not illustrated) on the one face Pa is supplied and the leading end Pc of the recording medium P passes the nip portion N of the fixing roller 61 and the pressing roller 62 and reaches the upstream edge 71*a* of the first separator 70, the recording medium P is separated from the surface 61*a* of the fixing roller 61 by being scooped up by the upstream edge 70*b* of the first separator 70.

Thereafter, the leading end Pc of the recording medium P is guided by the first separator 70 and is directed to the discharging roller pair 14 as shown in FIGS. 6C through 7C.

Figure 7A:
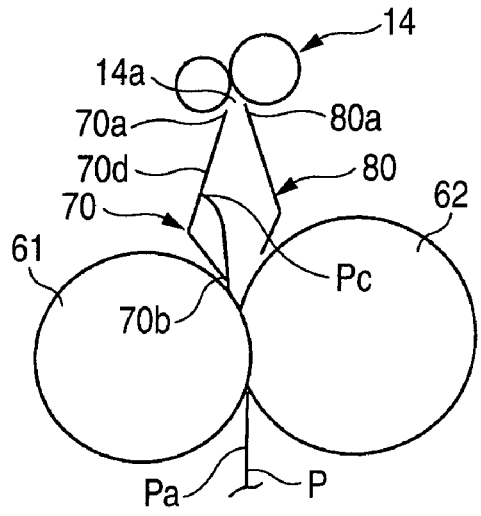
Figure 7B:
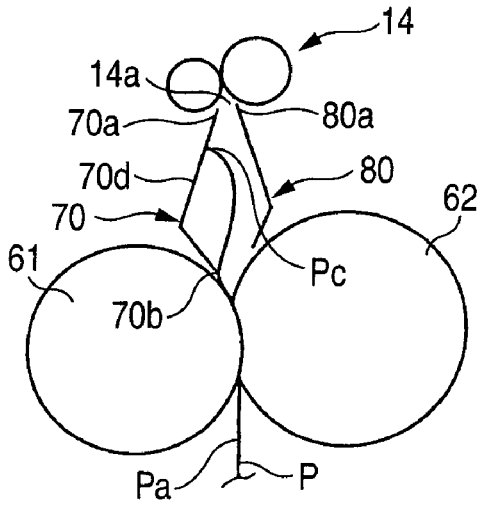
Figure 7C:
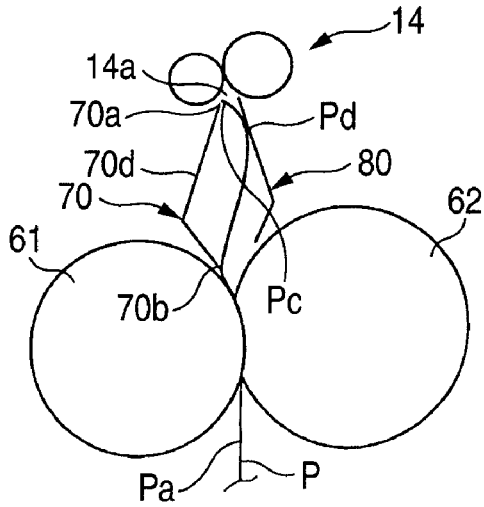

As described above, the recording medium P is bent in the direction the same as that of the shape of the nip portion N and therefore, as shown in FIG. 7C, the top portion Pd of the bent portion of the recording medium P is brought into contact with the second separator 80. In this case, the first separator 70 is bent and the guide face is brought into a state of escaping (regressing) from the toner adhering face Pa of the recording medium P and therefore, the toner adhering face Pa is difficult to paste on the first separator 70.

Figure 8:
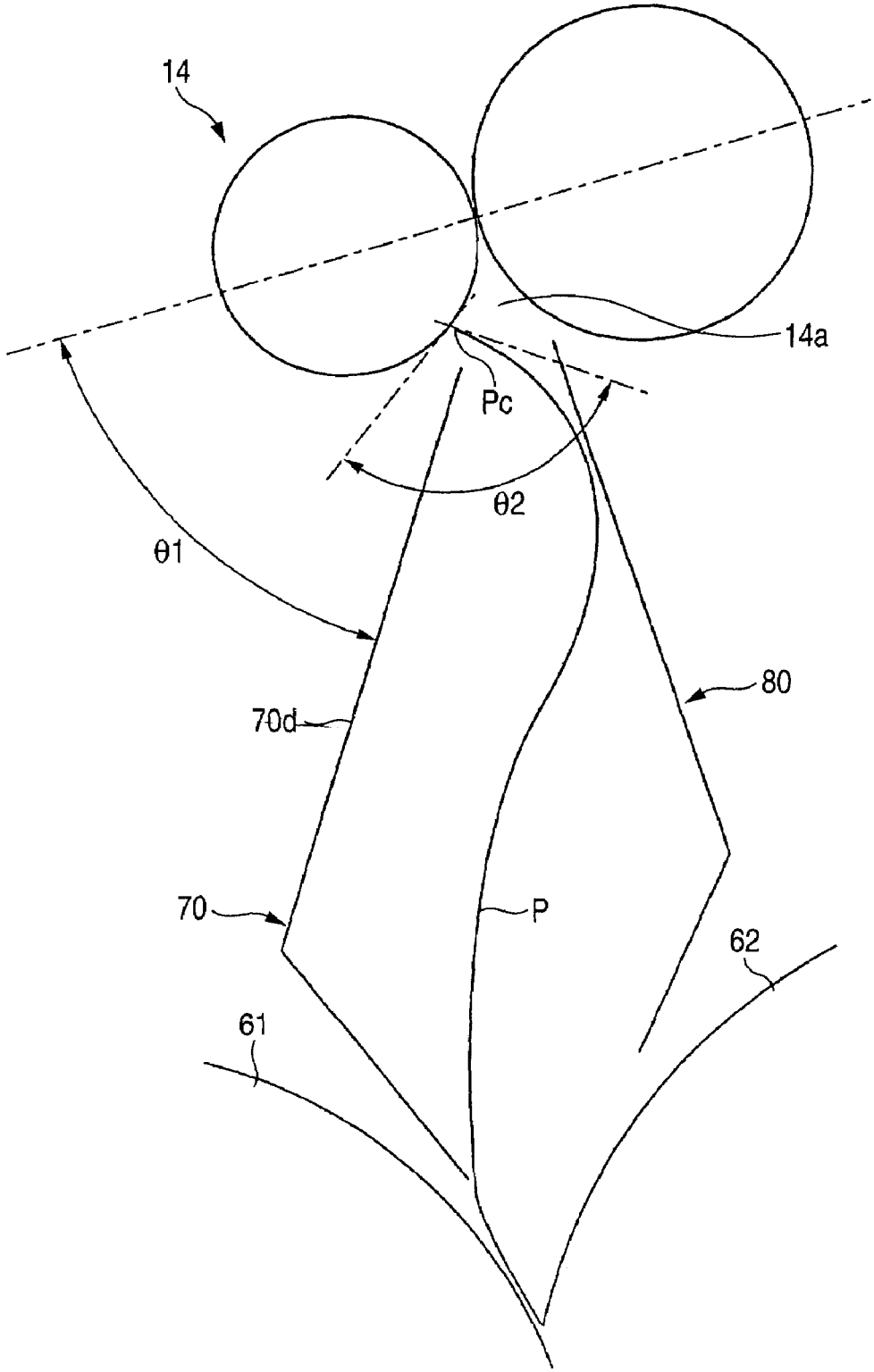

However, only the upstream portion of the first separator 70 is bent and therefore, as shown in FIG. 8, a guide angle θ1 to the discharging roller pair 14 by a downstream portion 70*d* of the first separator 70 cannot be reduced.

As a result, an angle θ2 of the leading end Pc of the bent recording medium P advancing to the discharging roller pair 14 (contact angle to roller) is increased, the leading end Pc of the recording medium P is difficult to be guided to the inlet 14*a* of the discharging roller pair 14 and paper jam is liable to be brought about.

Figure 9A:
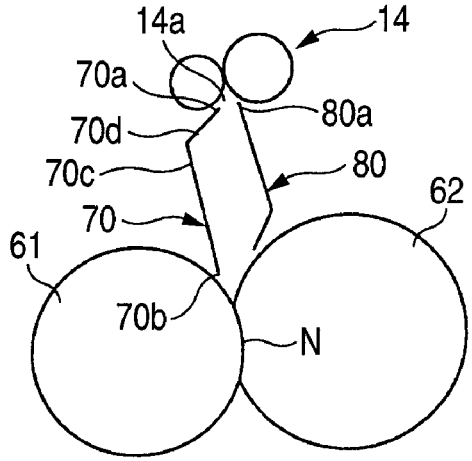
FIGS. 9A through 11 are views for explaining operations of a fixing device according to a third comparative example.

FIG. 9A shows the third comparative example in which the downstream end 70*a* of the first separator 70 and the downstream end 80*a* of the second separator 80 are arranged at a vicinity of the inlet 14*a* of the discharging roller pair 14 and only the downstream portion of the first separator 70 is bent.

Figure 9B:
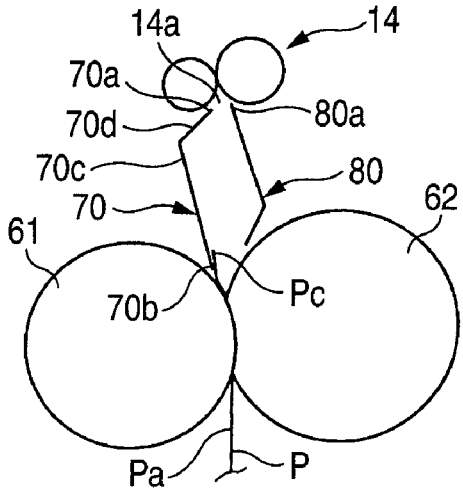
Figure 9C:
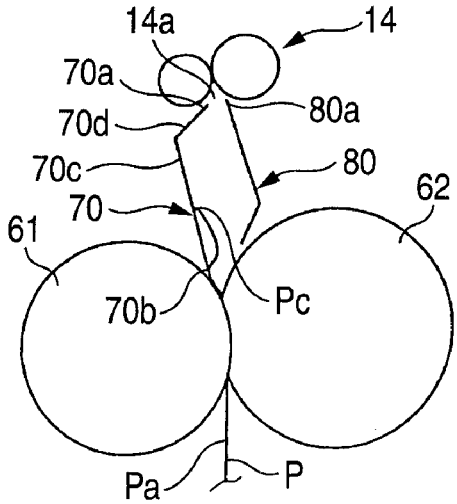

As shown in FIG. 9B, when the recording medium P formed with a toner image (not illustrated) on the one face Pa is supplied and the leading end Pc of the recording medium P passes the nip portion N of the fixing roller 61 and the pressing roller 62 and reaches the upstream edge 71*a* of the first separator 70, the recording medium P is separated from the surface 61*a* of the fixing roller 61 by scooping up the leading end Pc by the upstream edge 70*b* of the first separator 70.

Thereafter, the leading end Pc of the recording medium P is guided by the first separator 70 and directed to the discharging roller pair 14 as shown in FIGS. 9C through 10C.

However, only the downstream portion of the first separator 70 is bent and therefore, as shown in FIG. 9A, an angle θ3 between the upstream portion 70*c* and the downstream portion 70*d* cannot be increased.

Figure 10A:
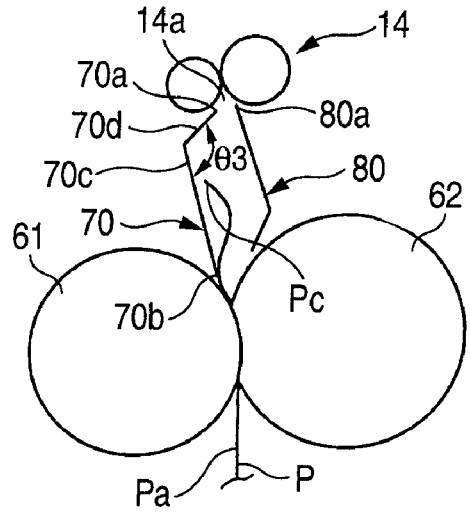
Figure 10B:
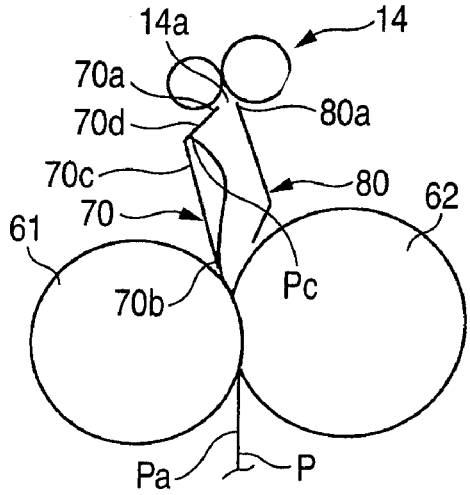
Figure 10C:
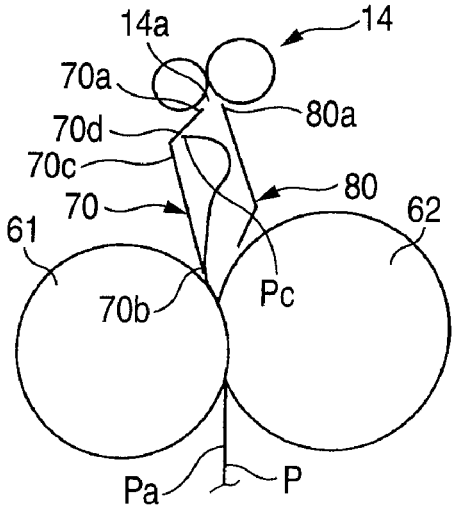
Figure 11:
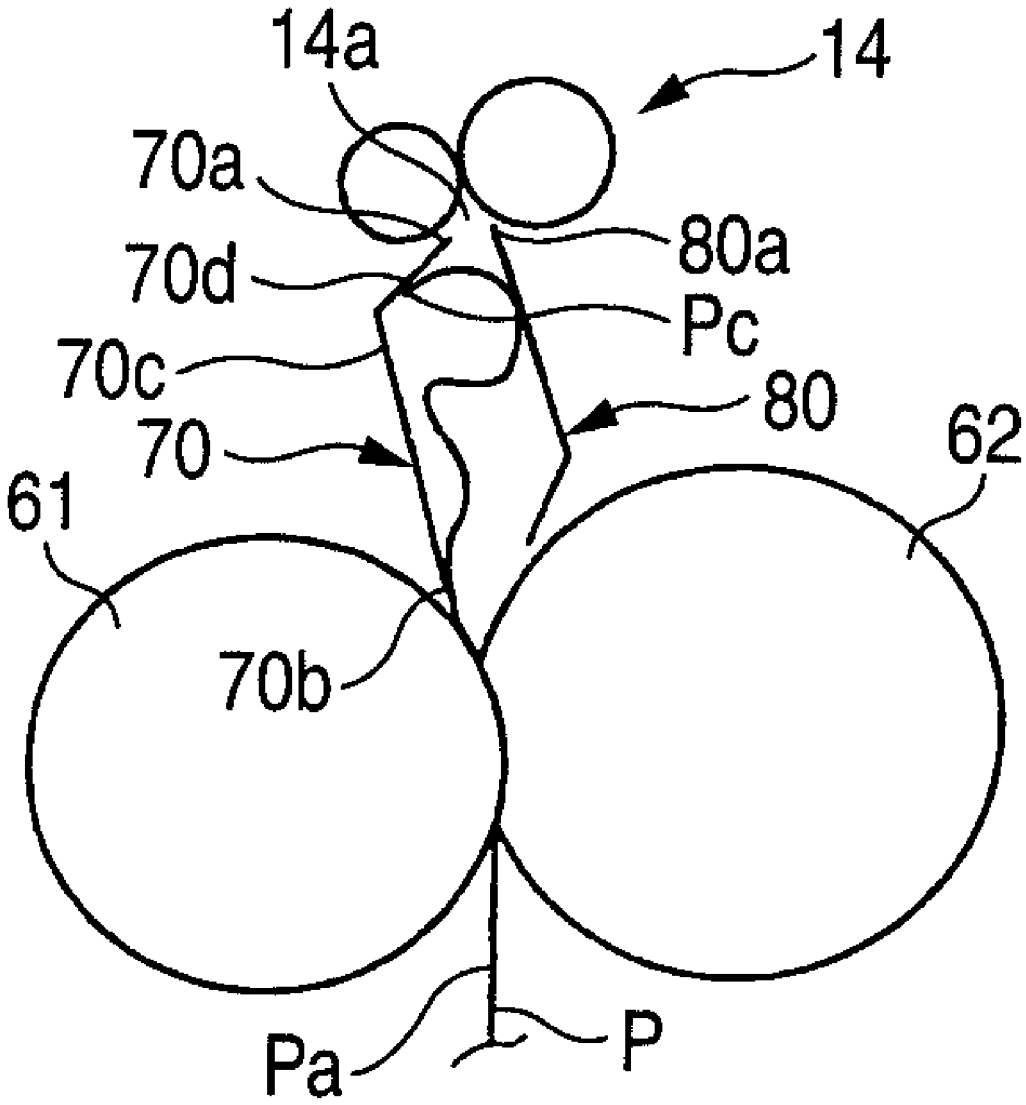

As described above, the recording medium P is bent in a direction the same as that of the shape of the nip portion N and therefore, when the bent angle θ3 is small, as shown in FIG. 10B, movement of the leading end Pc of the recording medium P is liable to be hampered by bringing the leading end Pc into contact with the downstream portion 70*d* of the first separator 70, and as shown in FIG. 10C, bending of the recording medium P is further promoted. As a result, as shown in FIG. 11, the recording medium P is rounded from the front end and paper jam is liable to be brought about. This case is substantially the same as a case where the guide angle θ1 in the first comparative example is excessively reduced.

As described above, paper jam is liable to be brought about in all of the above comparative examples.

Figure 12A:
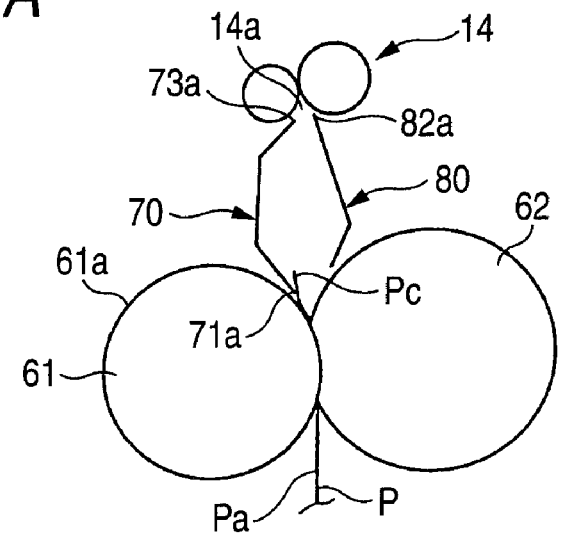
FIGS. 12A through 14 are views for explaining operations of the fixing device of FIG. 2.
Figure 12B:
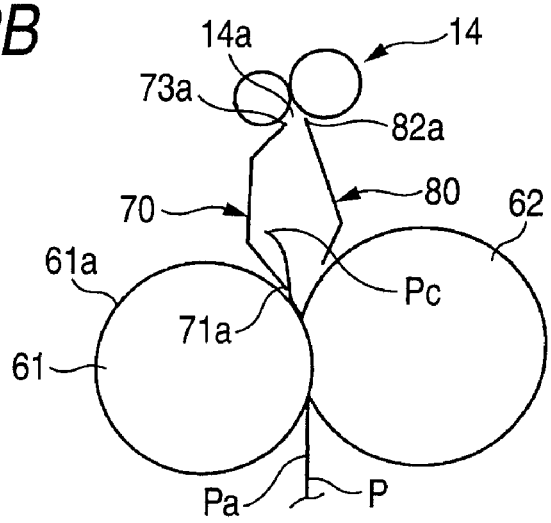
Figure 12C:
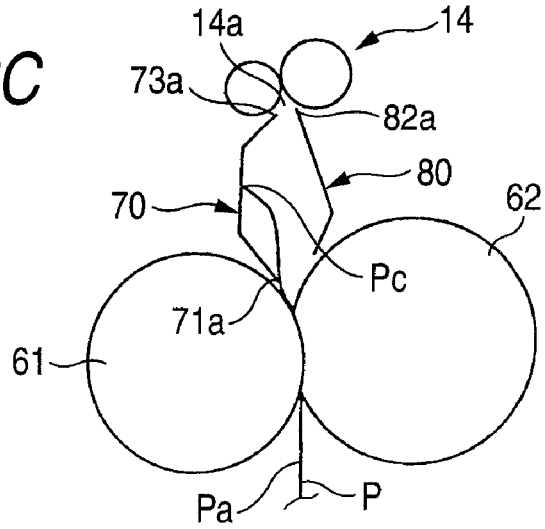

In the above-described fixing device 60 according to the embodiment of the invention, as shown in FIG. 12A, when the recording medium P formed with a toner image (not illustrated) on the one face Pa is supplied and the leading end Pc of the recording medium P passes the nip portion N of the fixing roller 61 and the pressing roller 62, and reaches the upstream edge 71*a* of the first separator 70. The recording medium P is separated from the surface 61*a* of the fixing roller 61 by scooping up the leading end Pc by the upstream edge 71*a* of the first separator 70 (refer to FIG. 12B).

Thereafter, the leading end Pc of the recording medium P is guided by the first separator 70 and is directed to the discharging roller pair 14 as shown in FIGS. 12C through 13B.

Figure 13A:
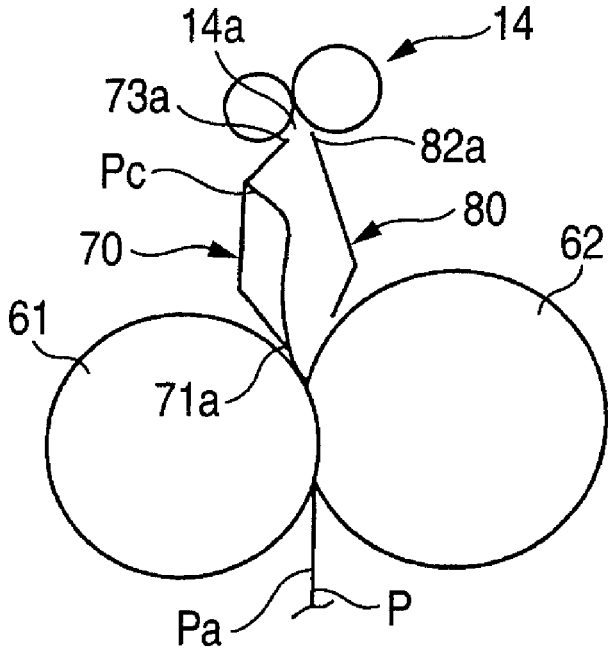

As described above, the recording medium P is bent, in a procedure of proceeding to the discharging roller pair 14, as shown in FIG. 13A, the leading end Pc of the recording medium P is brought to a bent portion of the second guide face 72 and the third guide face 73. In the embodiment, since the first separator 70 is bent in two stages, a bent angle θ4 between the second guide face 72 and the third guide face 73 is larger than the bent angle θ3 (refer to FIG. 10A) in the third comparative example.

Figure 13B:
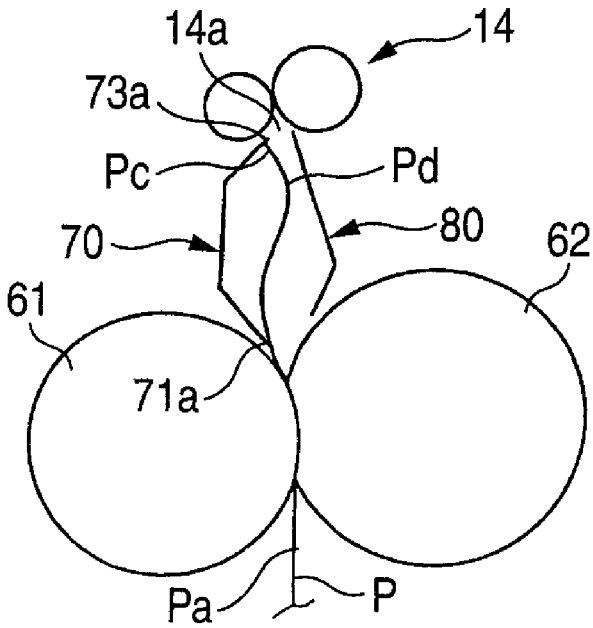
Figure 14:
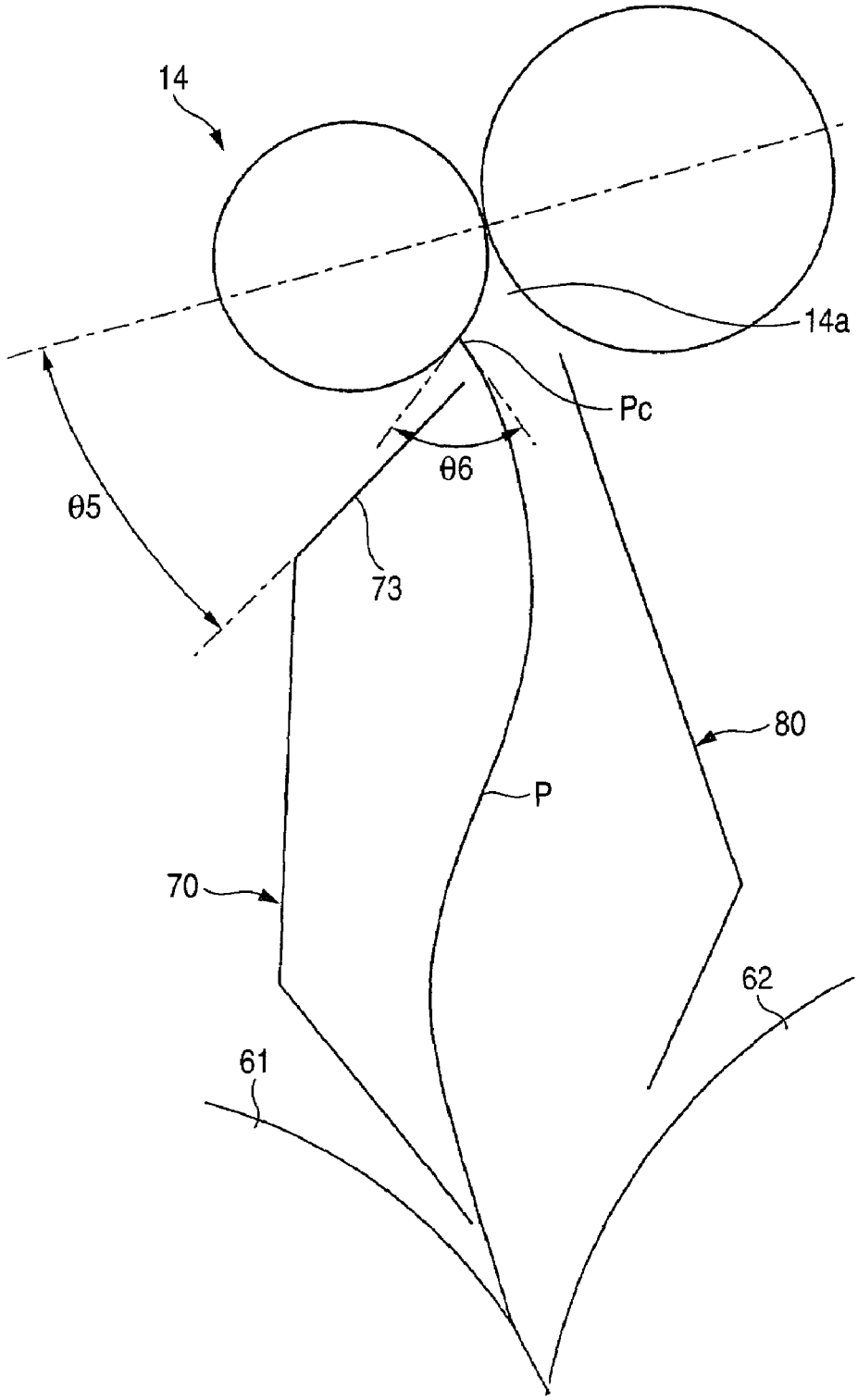

Therefore, even when the recording medium P is bent, movement of the leading end Pc of the recording medium P is difficult to be hampered by the third guide face 73 and as shown in FIG. 13B, the recording medium P is smoothly guided to the discharging roller pair 14 by the third guide face 73.

In a procedure of guiding the recording medium P to the discharging roller pair 14 by the third guide face 73, depending on the state of bending the recording medium P, the top portion may be brought into contact with the second separator 80. However, the first separator 70 is bent in two stages and the guide faces 71 through 73 are escaped (regressed) from the toner adhering face Pa of the recording medium P and therefore, the toner adhering face Pa is difficult to paste on the first separator 70.

Thereafter, the recording medium P is further guided by the third guide face 73, and the leading end Pc is brought into contact with the discharging roller pair 14 while being deviated from the downstream end 73*a* of the third guide face 73. In the embodiment, since the first separator 70 is bent in two stages, a guide angle θ5 to the discharging roller pair 14 by the third guide face 73 becomes smaller than θ1 (refer to FIG. 8) in the second comparative example.

As a result, an angle θ6 of the leading end Pc of the bent recording medium P advancing to the discharging roller pair 14 (contact angle to roller) becomes smaller than the angle θ2 (refer to FIG. 8) in the second comparative example. Therefore, the leading end Pc is liable to be guided to the inlet 14*a* of the discharging roller pair 14 and paper jam is made to be difficult to be brought about.

Therefore, according to the embodiment, the leading end of the recording medium P can smoothly be guided to the inlet 14*a* of the discharging roller pair 14 while the toner adhering face of the recording medium P can be restrained from pasting on the separator. As a result, paper jam is made to be difficult to be brought about.

The above-described advantages are achieved similarly in the above described case where the guide face of the first separator 70 includes at least one guide face subsequent to the third guide face 73.

Figure 15:
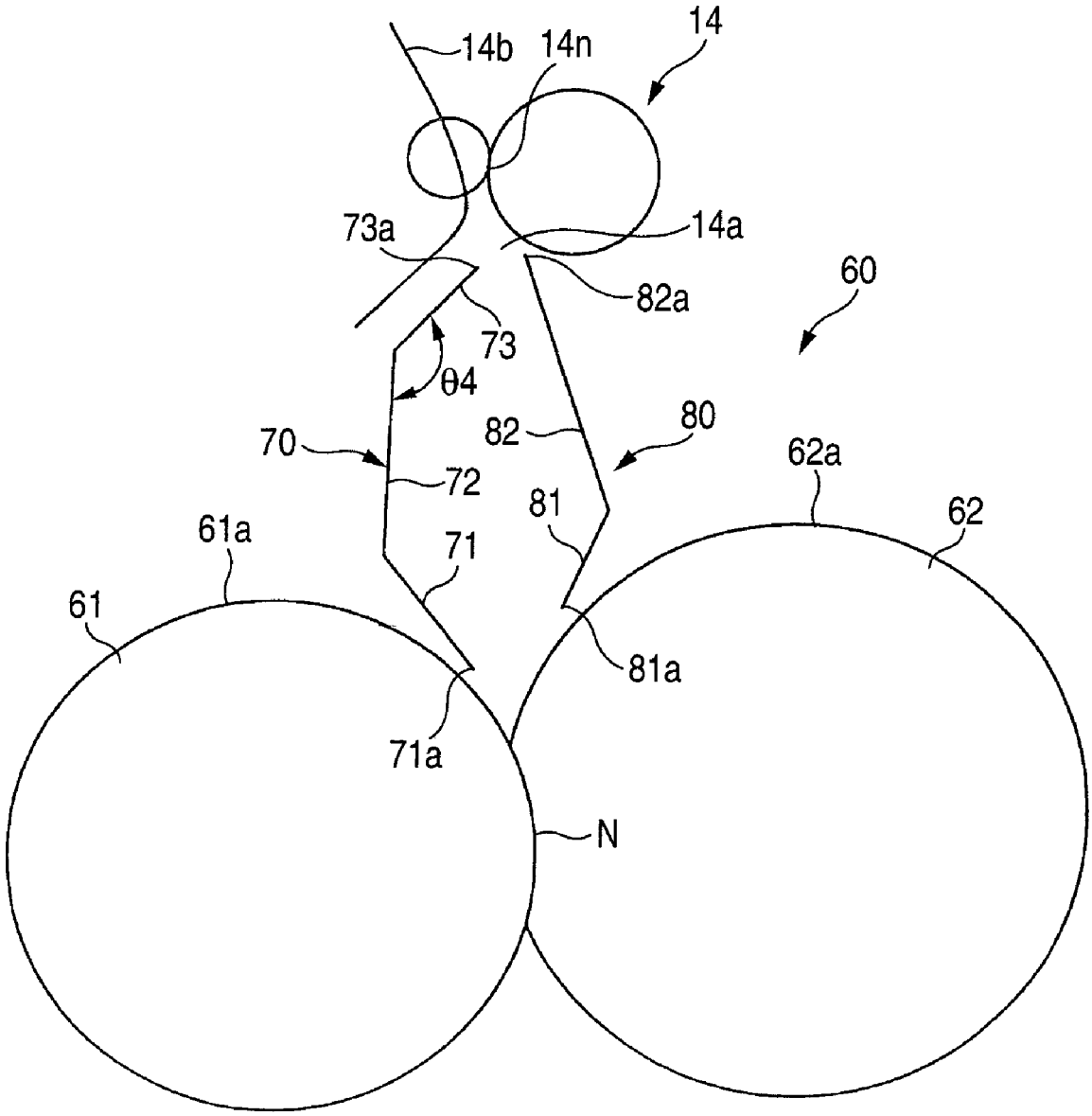
FIG. 15 shows an enlarged side view showing a modified example of the fixing device of FIG. 2.

FIG. 15 shows a modified example of the first embodiment of the invention. In this example, the discharging roller pair is provided with a guide member 14*b*. Also in this case, the above advantages can be attained by arranging the both downstream edges of the first separator 70 and the second separator 80.

A second embodiment of the invention will be described below. Elements as same as those in the first embodiment are designated by the same reference numerals.

As shown by FIG. 16 through FIG. 18C, the first separator 70 comprises: a first guide face 71 in which an upstream edge 71*a* is proximate to a surface 61*a* of the fixing roller 61; a second guide face 72 continuous to the first guide face 71 on the downstream side of the transporting direction of the recording medium P, and bent relative to the first guide face 71; and a third guide face 73 continuous to the second guide face 72 on the downstream side in the transporting direction the recording medium P, and bent relative to the second guide face 72. The second guide face 72 is provided with a rib 74 extended in the transporting direction the recording medium P.

The first separator 70 is constituted by bending one sheet of a metal plate, thereby, the first through the third guide faces 71 through 73 are formed. The guide faces of the first separator 70 are coated with fluororesin or the like excellent in separating performance with respect to the toner.

The fixing roller 61 is formed by a gradual inverse crown shape and therefore, the upstream edge 71*a* is so curved as to be in line with the shape of the fixing roller 61.

Numeral 75 designates a support member of the first separator 70 which is fixedly attached to a back face side of the first separator 70. An obverse side of the support member 75 is formed with a plurality of the ribs 74 arranged side by side in a longitudinal direction thereof (axial direction of the fixing roller 61).

Meanwhile, the second guide face 72 of the first separator 70 is provided with holes 72*a* at position in correspondence with positions of the ribs 74. The ribs 74 are protruded from the holes 72*a* in the second guide face 72 by bonding the back face side of the first separator 70 and the obverse side of the support member 75.

Figure 18C:
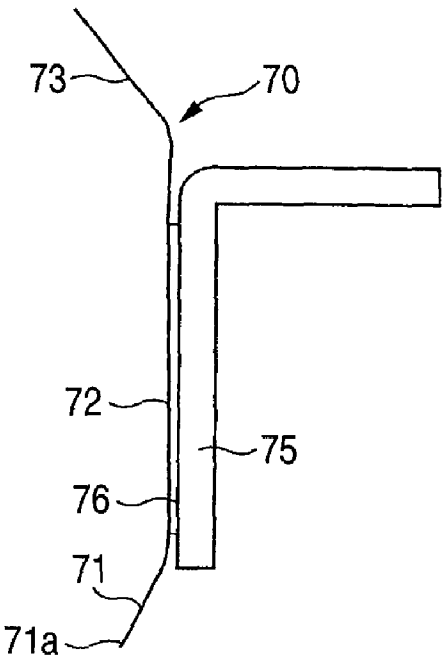
FIG. 18C is a section view taken along a line 18C—18C in FIG. 17A.
Figure 18B:
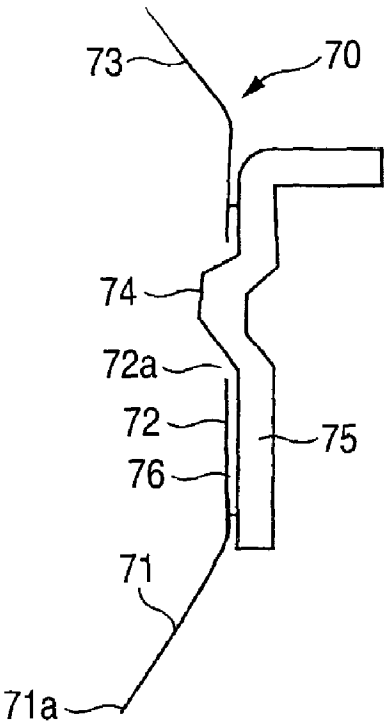
FIG. 18B is a section view taken along a line 18B—18B in FIG. 17A.
Figure 18A:
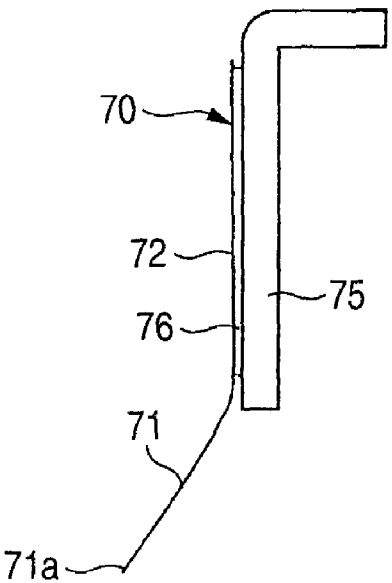
FIG. 18A is a section view taken along a line 18A—18A in FIG. 17A.

As shown in FIGS. 18A to 18C, the first separator 70 and the support member 75 are fixedly attached to each other by, for example, spot welding and/or an adhering agent (for example, fluororesin as the coating member) 76 having heat insulating performance.

Further, both ends of the support member 75 are attached to a not-shown frame of the fixing device 60.

Figure 16:
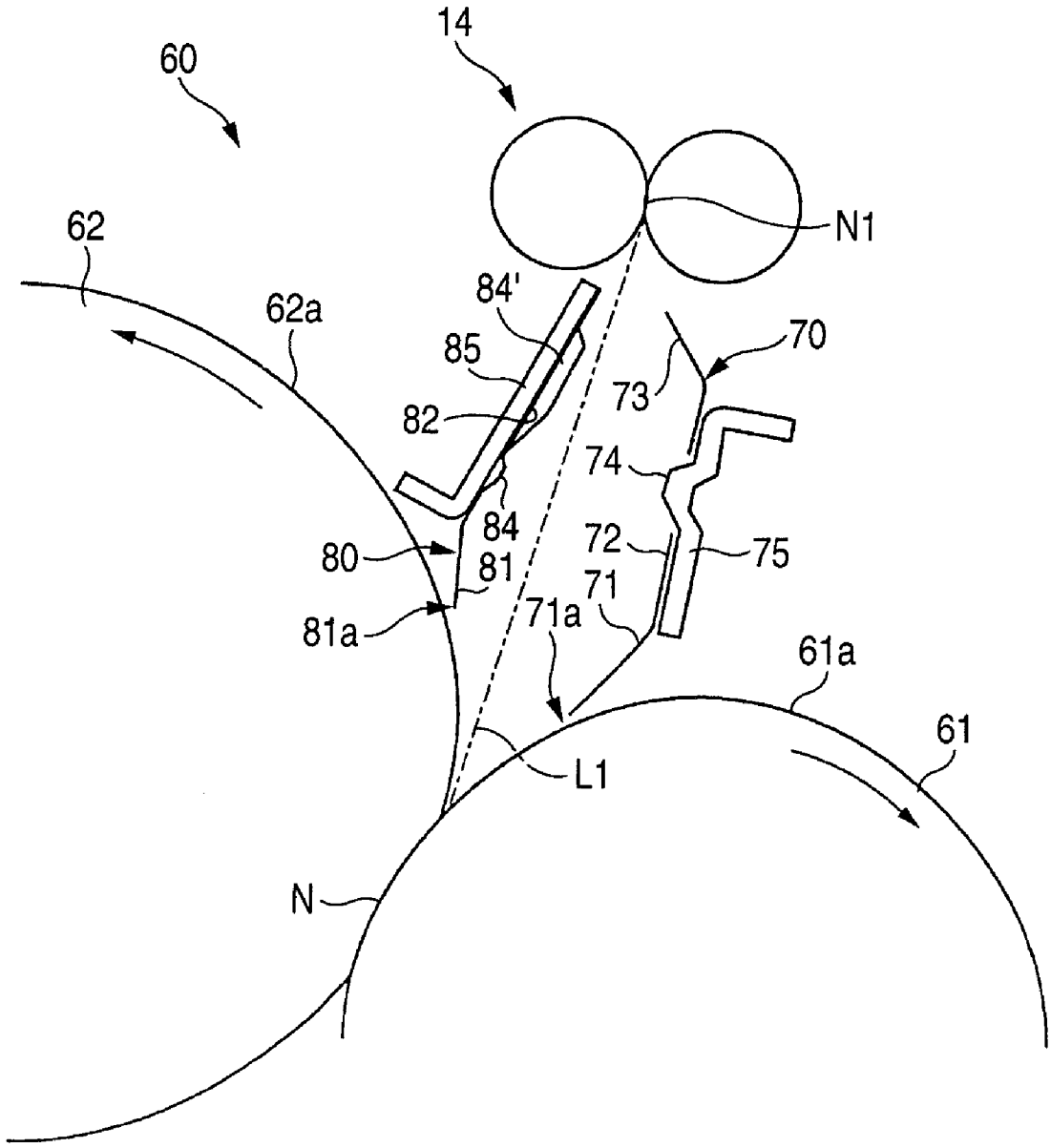
FIG. 16 is an enlarged side view showing an essential portion of a fixing device according to a second embodiment of the invention.
Figure 17A:
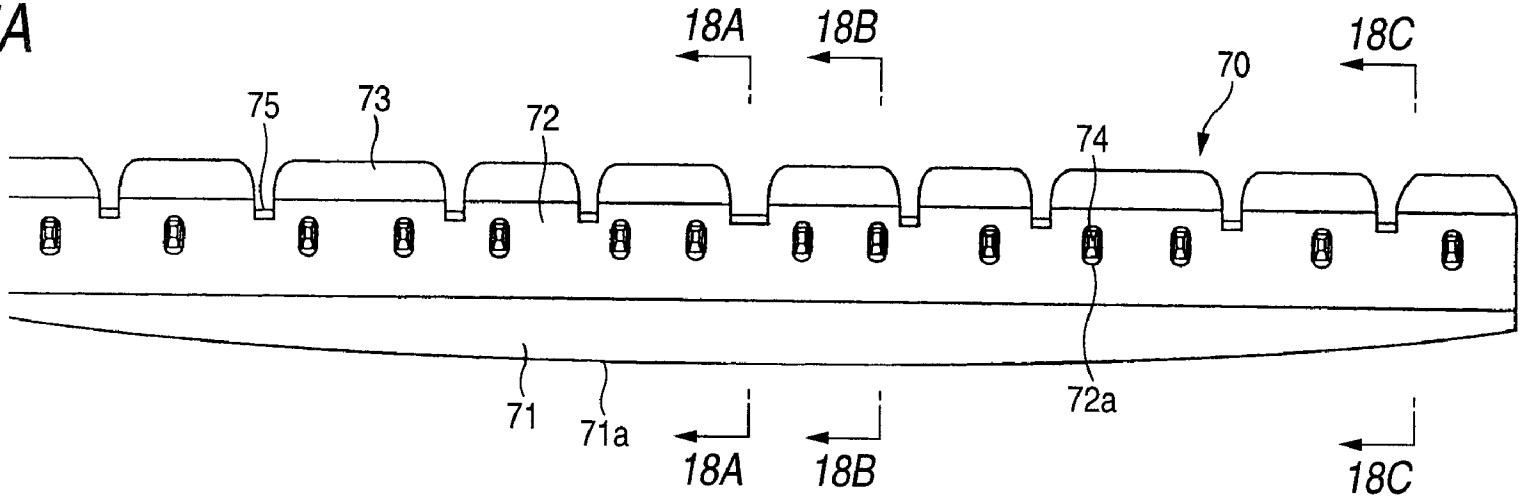
FIG. 17A is a plan view of a first separator in the fixing device of FIG. 16.
Figure 17B:
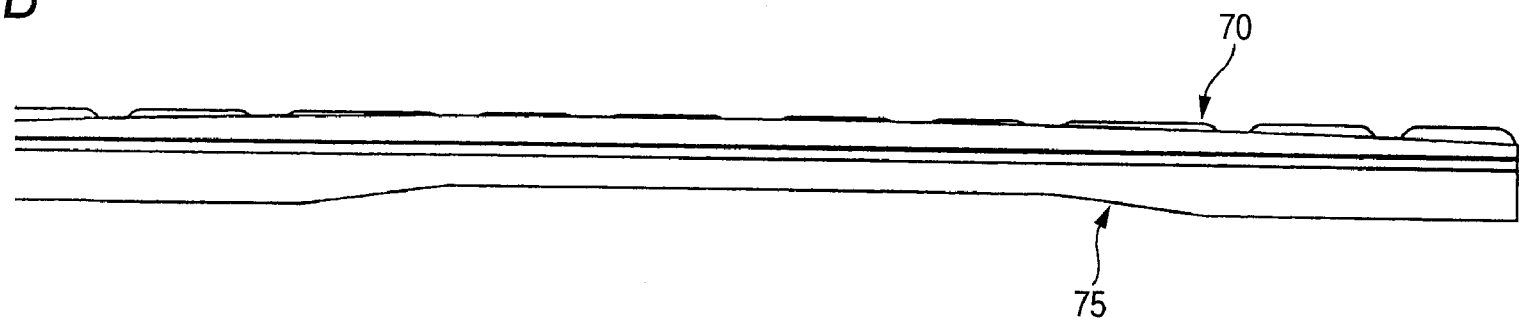
FIG. 17B is a rear side view of the first separator of FIG. 17A.

As is apparent from FIG. 16, the rib 74 is disposed on a side of the fixing roller 61 of a line connecting an outlet of the nip portion N and an inlet of a nip portion N1 of a discharge roller pair 14 (refer to imaginary line L1).

Figure 30:
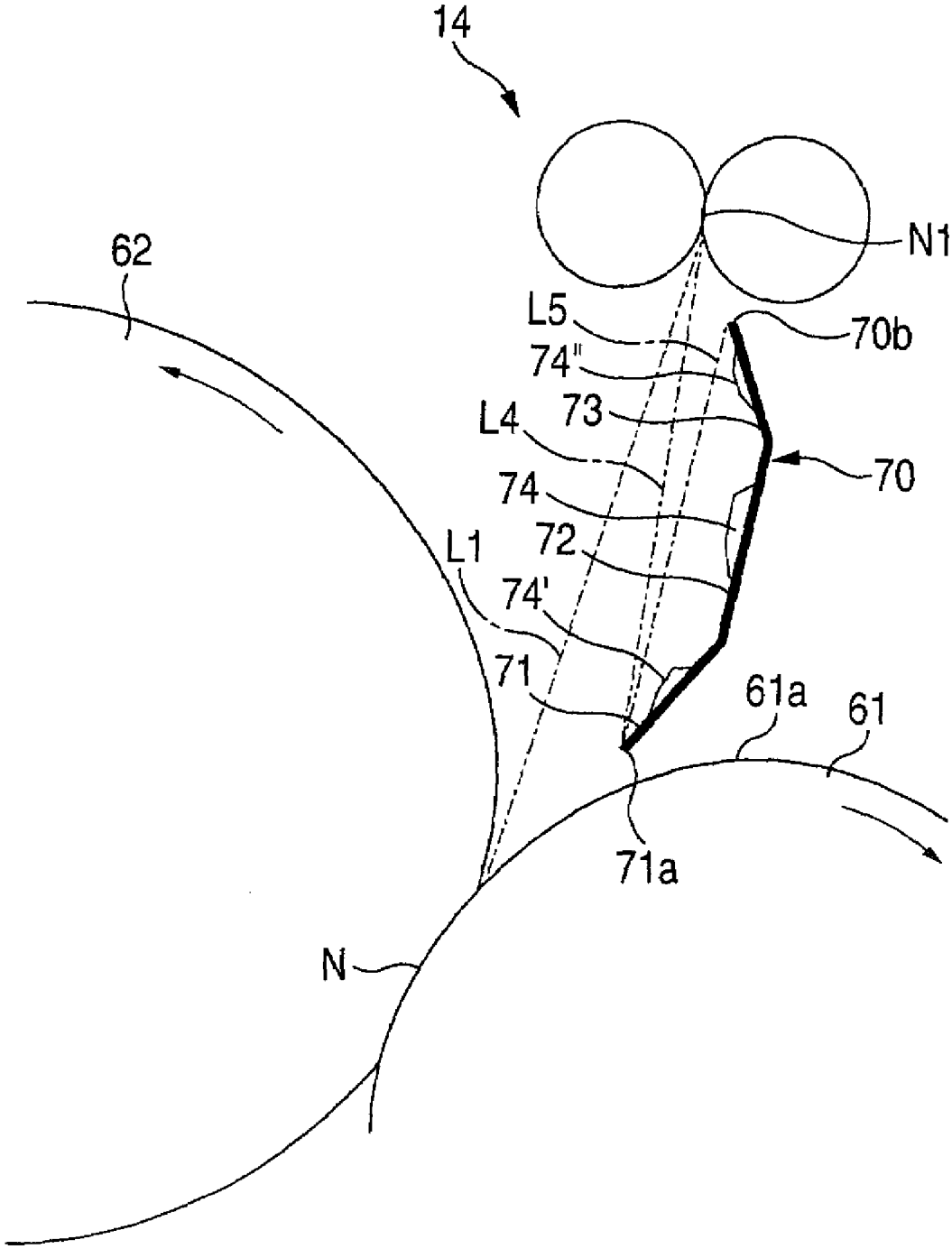
FIG. 30 is an enlarged side view showing an essential portion of a fixing device according to a fifth embodiment of the invention.

As shown in FIG. 30, the rib 74 is disposed on the side of the fixing roller 61 of a line L4 connecting the upstream end 71*a* of the first separator 70 and the inlet of the nip portion N1, and also disposed on the side of the fixing roller 61 of a line L5 connecting the upstream end 71*a* of the guide face and a downstream end 70*b* of the first separator 70.

As shown in FIGS. 16 and 19A through 20B, the second separator 80 comprises: a first guide face 81 in which an upstream edge 81*a* is proximate to a surface 62*a* of the pressing roller 62; and a second guide face 82 continuous to the first guide face 81 on the downstream side in the transporting direction the recording medium P, and bent relative to the first guide face 81. The second guide face 82 is provided with ribs 84 and 84' extended in the transporting direction the recording medium P.

Similar to the first separator 70, the second separator 80 is constituted by folding to bend one sheet of a metal plate, thereby, the first and the second guide faces 81 and 82 are formed. The guide faces of the second separator 80 are coated with fluororesin or the like excellent in separating performance with respect to the toner.

Numeral 85 designates a support member of the second separator 80, which is fixedly attached to the back face side of the second separator 80. A obverse side of the support member 85 is formed with pluralities of the ribs 84 and 84' arranged side by side in a longitudinal direction thereof (axial direction of the pressing roller 62).

Meanwhile, the second guide face 82 of the second separator 80 is provided with holes 82*a* and 82*a*' at positions in correspondence with positions of the ribs 84 and 84'. The ribs 84 and 84' are protruded from the holes 82*a* and 82*a*' in the second guide face 82 by bonding to fixedly attach the back face side of the second separator 80 and the obverse side of the support member 85.

Figure 20A:
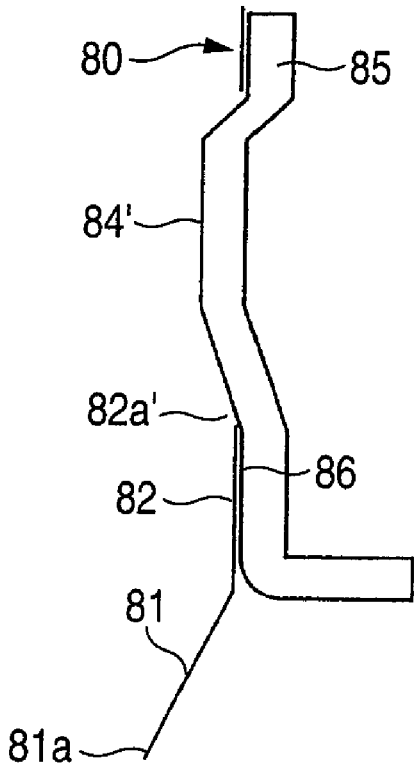
FIG. 20A is a section view taken along a line 20A—20A in FIG. 19B.
Figure 20B:
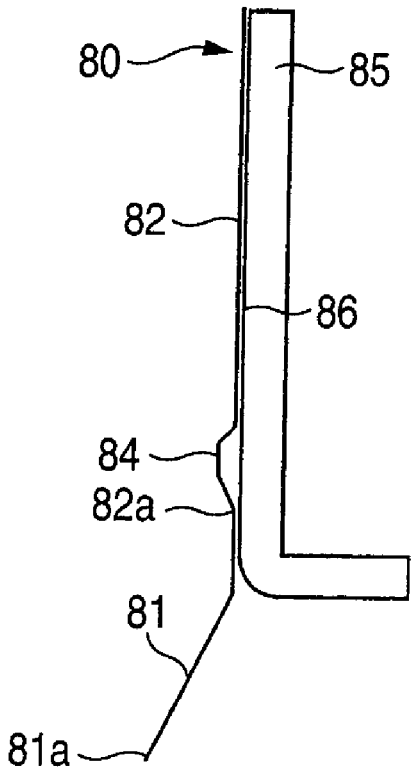
FIG. 20B is a section view taken along a line 20B—20B in FIG. 19B.

As shown in FIGS. 20A and 20B, the second separator 80 and the support member 85 are fixedly attached by, for example, spot welding and/or an adhering agent (for example, fluororesin as the coating member) 86 having insulating performance.

As is apparent from FIG. 16, the ribs 84 and 84' are disposed on a side of the pressing roller 62 of the line (refer to imaginary line L1) connecting the outlet of the nip portion N and the inlet of the nip portion N1.

Figures 19A, 19B, 19C:
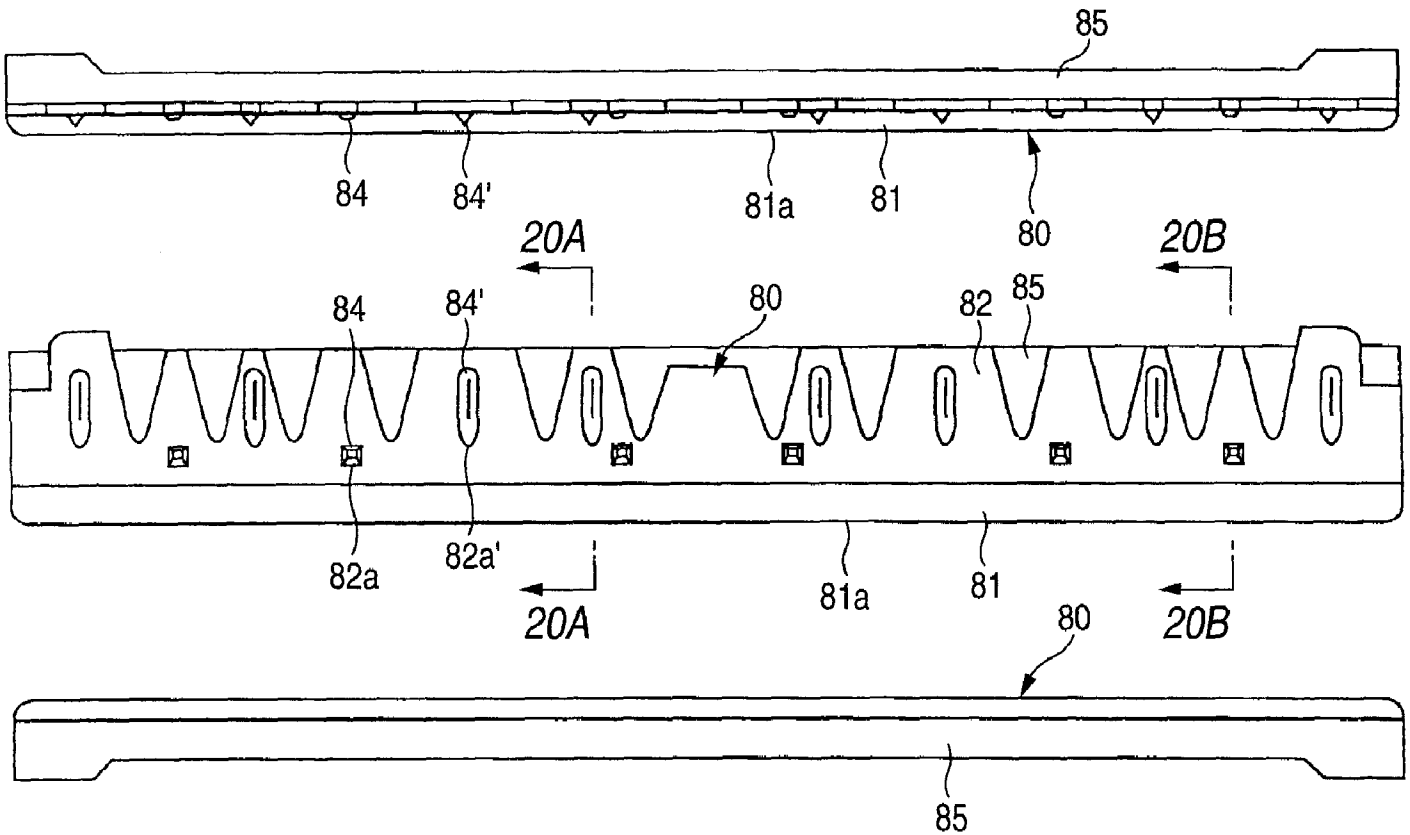
FIG. 19A is front side view of a second separator in the fixing device of FIG. 16.
FIG. 19B is a plan view of the second separator of FIG. 19A.
FIG. 19C is a rear side view of the second separator of FIG. 19A.

As is apparent from FIG. 19B, the ribs 84 and 84' are arranged in a zigzag manner.

Both ends of the support member 85 are attached to a not-shown frame of the fixing device 60.

Advantages obtained by the first separator 70 and the second separator 80 are basically the same and therefore, an explanation will mainly be given of the advantages of the first separator 70 with reference to FIGS. 21 through 27.

Figure 21:
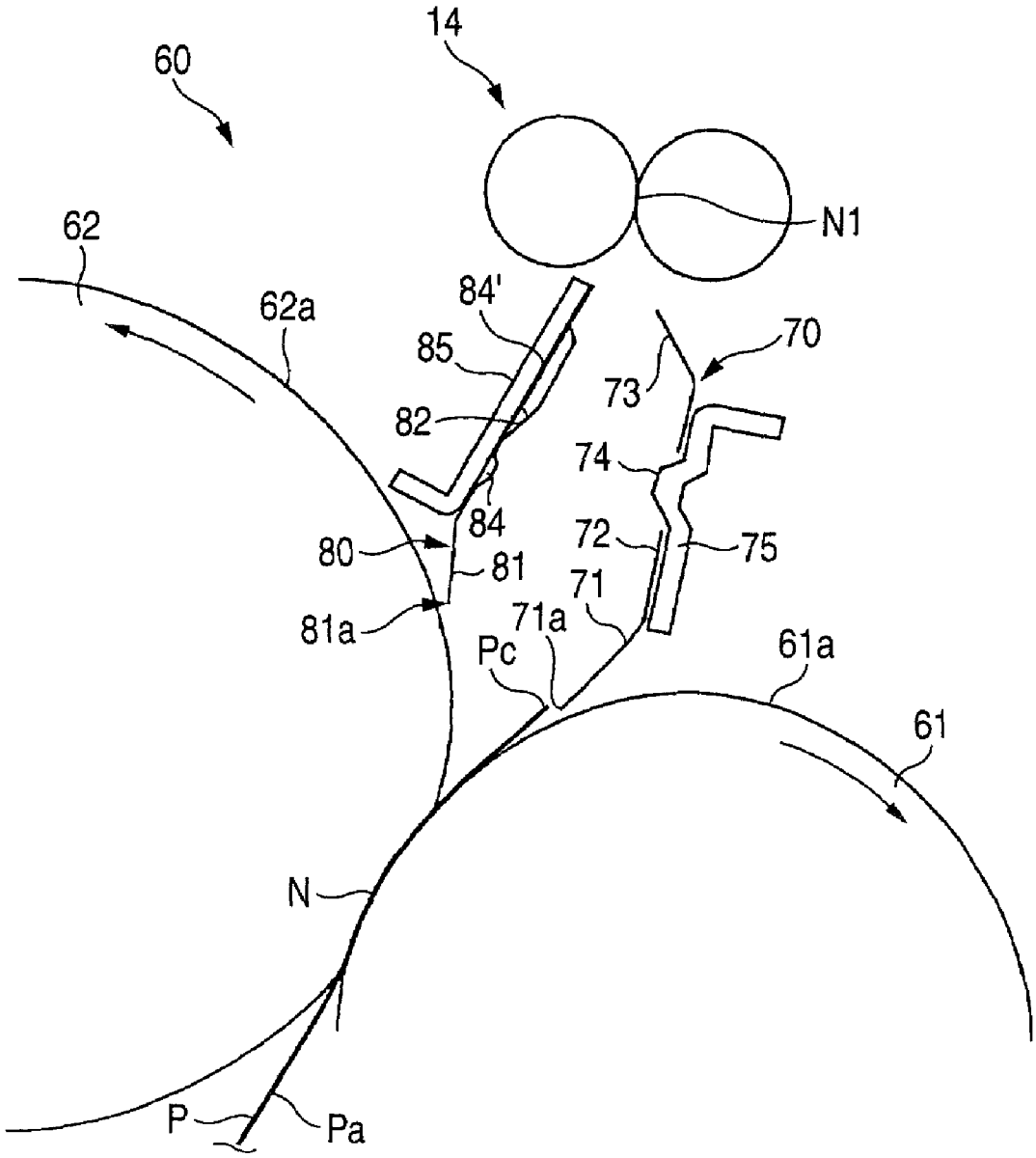
FIGS. 21 through 27 are views for explaining operations of the fixing device of FIG. 16.
Figure 22:
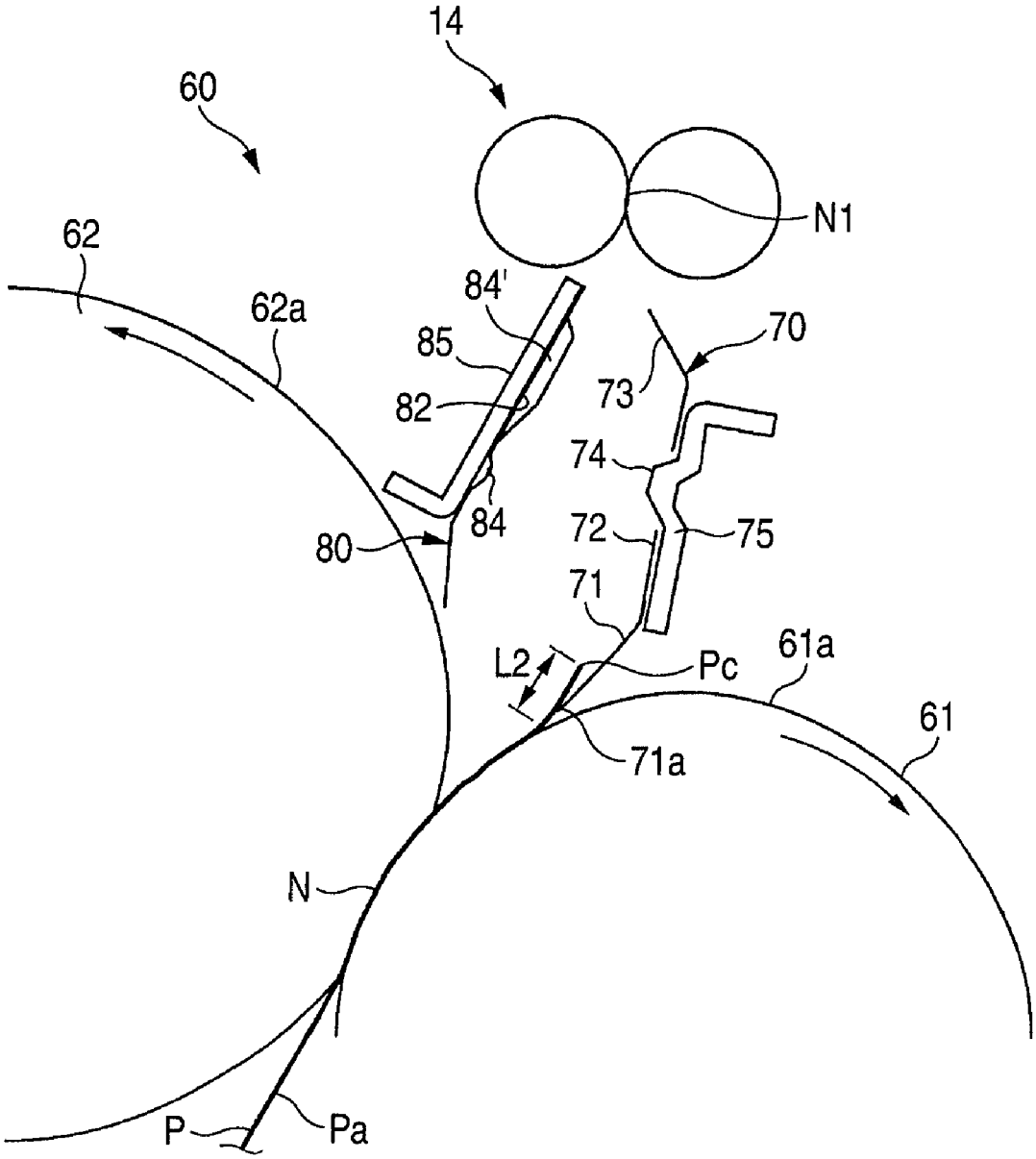

When the recording medium P formed with a toner image (not illustrated) on the one face Pa is supplied as shown in FIG. 21, the leading end Pc of the recording medium P passes the nip portion N of the fixing roller 61 and the pressing roller 62 and reaches the upstream edge 71*a* of the first separator 70 as shown in FIG. 22, the leading end Pc is separated from the surface 61*a* of the pressing roller 61 by being scooped up by the upstream edge 71*a* of the first separator 70. Normally, as shown in FIG. 21, the front end portion of the recording medium P is constituted by a non image region (region without toner) in which the toner image is not formed and is liable to leave from the surface 61*a* of the fixing roller 61 and therefore, the separating operation of the recording medium P is excellently achieved.

Figure 23:
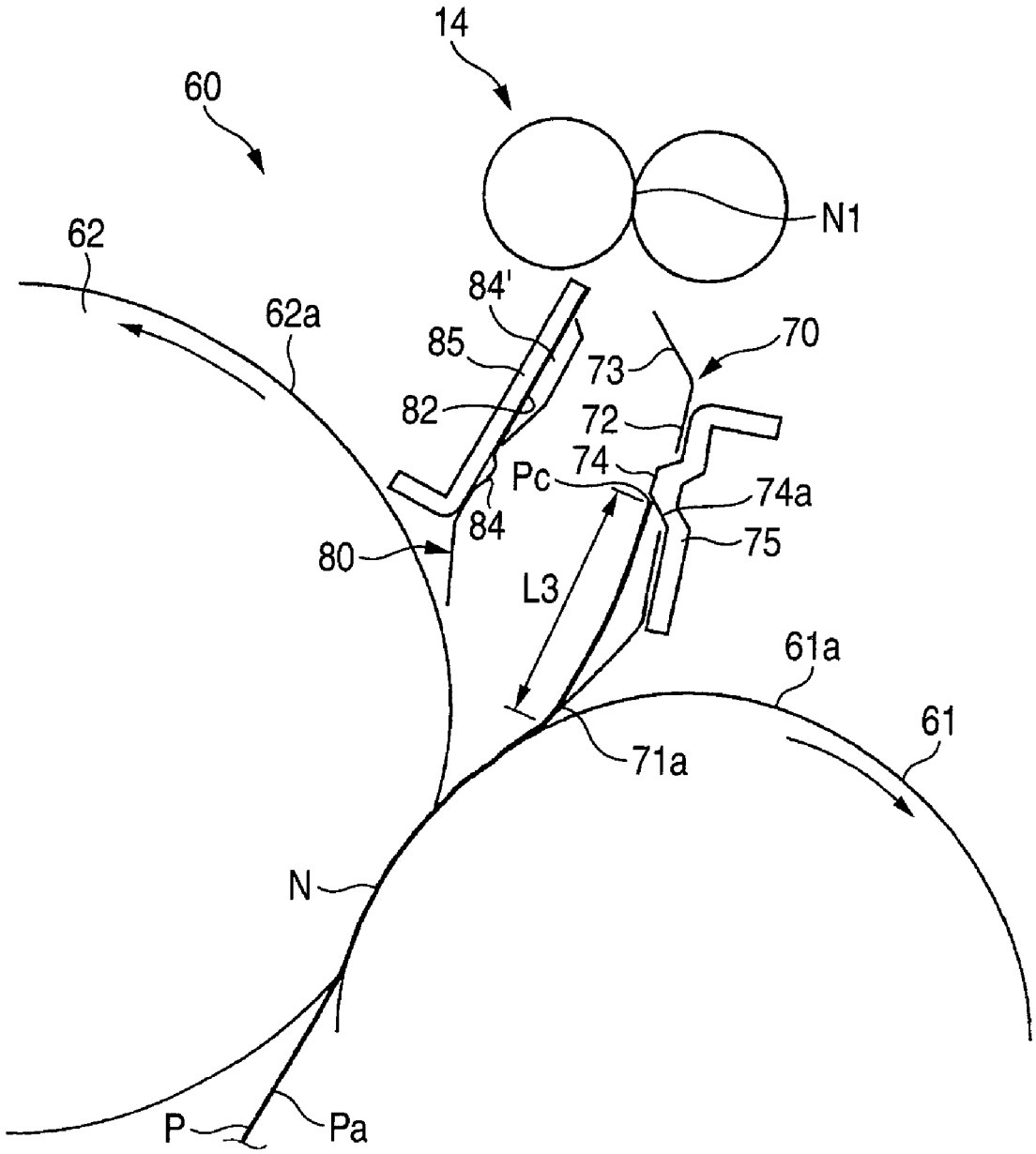
Figure 24:
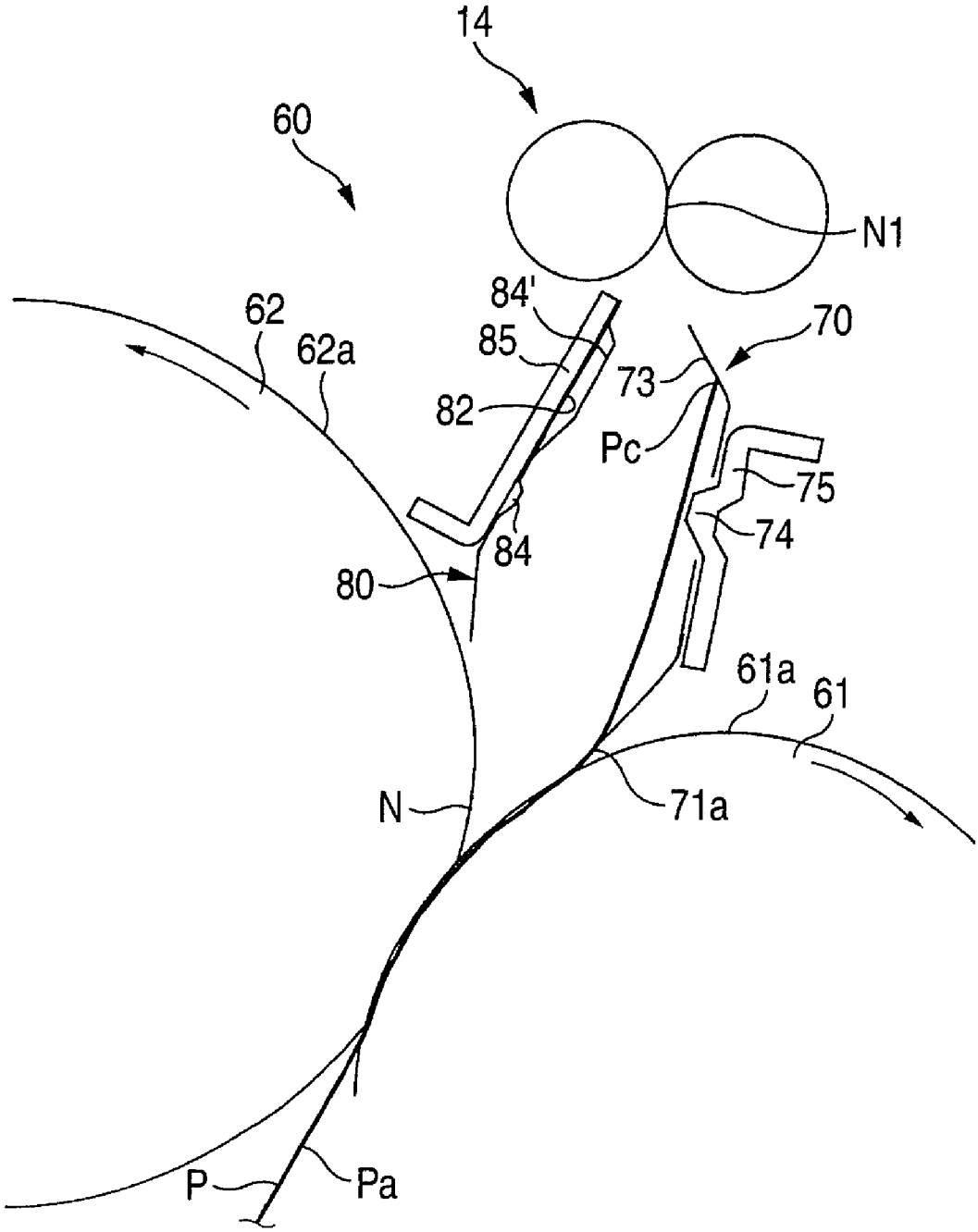

Thereafter, the leading end Pc of the recording medium P is guided by the first guide face 71 of the first separator 70, then guided by the second guide face 72 and a sloped guide face 74*a* of the rib 74 as shown in FIG. 23. The leading end Pc is then guided by the third guide face 73 as shown in FIG. 24 to direct to the discharge roller pair 14.

Figure 25:
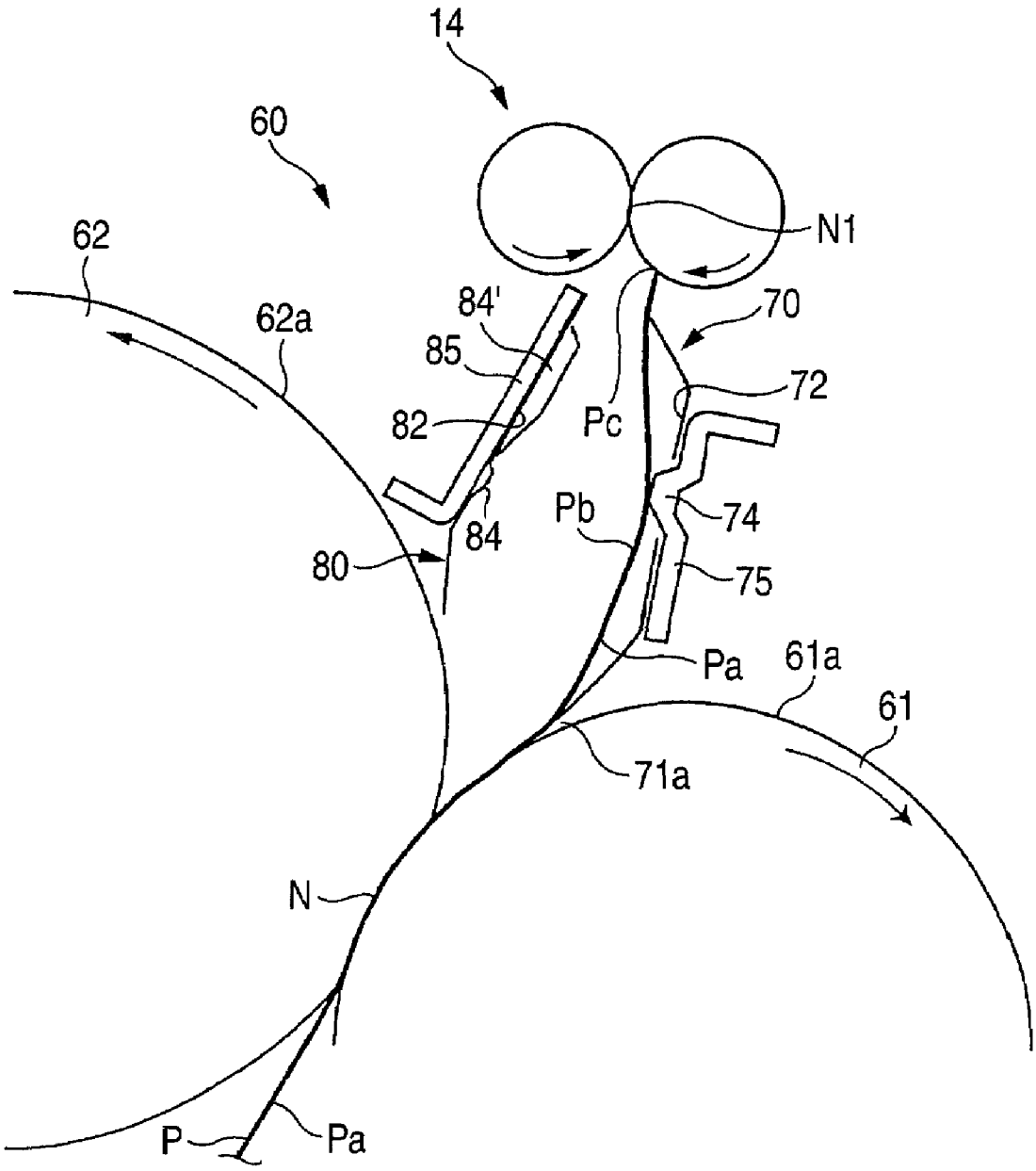

At this occasion, as shown in FIG. 25, there is a case where the leading end Pc of the recording medium P collides on the discharge roller pair 14. When the colliding position is disposed at a position remote from the nip portion N1 of the discharge roller pair 14, the recording medium P continues to be fed by the fixing roller 61 and the pressing roller 62 during the time period until the leading end Pc of the recording medium P is brought into the nip portion N1 of the discharge roller pair 14. Therefore, there is a case where the recording medium P is temporarily bent significantly between the nip portion N and the discharge roller pair 14 so that the toner adhering face Pa is directed to the guide face (mainly the second guide face 72 as illustrated).

However, according to the embodiment, the rib 74 extended in the transporting direction the recording medium P is provided at the second guide face 72 and therefore, as shown in FIG. 25, by bringing the recording medium P into press contact with the rib 74, the toner adhering face Pa of the recording medium P is prevented from being brought into press contact with the second guide face 72. Further, the toner adhering face Pa is made to be difficult to be brought into press contact with also the first guide face 71 and the third guide face 73 by the operation of the rib 74 for restraining the recording medium P from being bent.

Therefore, the toner adhering face Pa of the recording medium P is made to be difficult to paste on the guide faces of the first separator 70, so that paper jam made to be difficult to be brought about.

Figure 26:
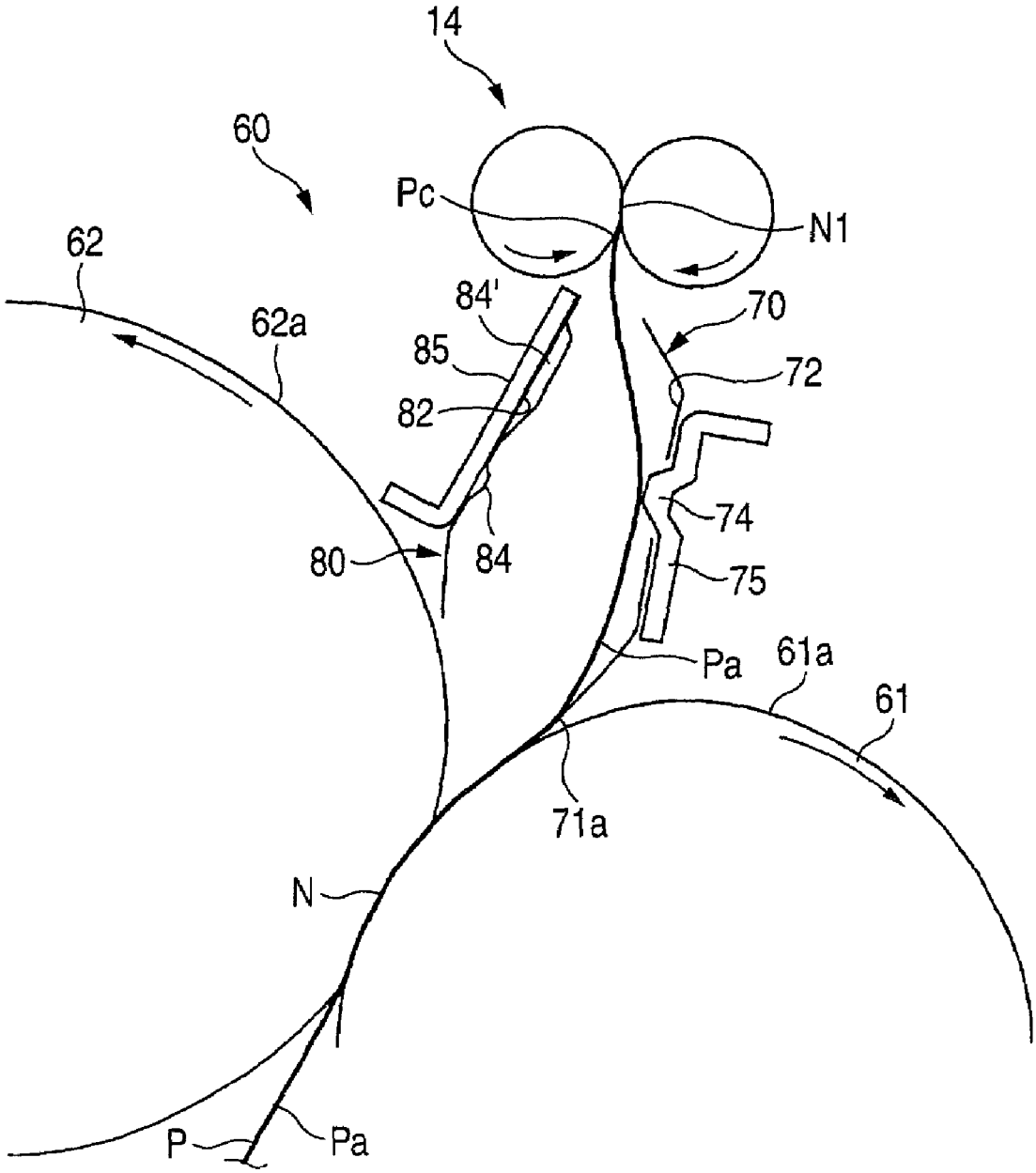
Figure 27:
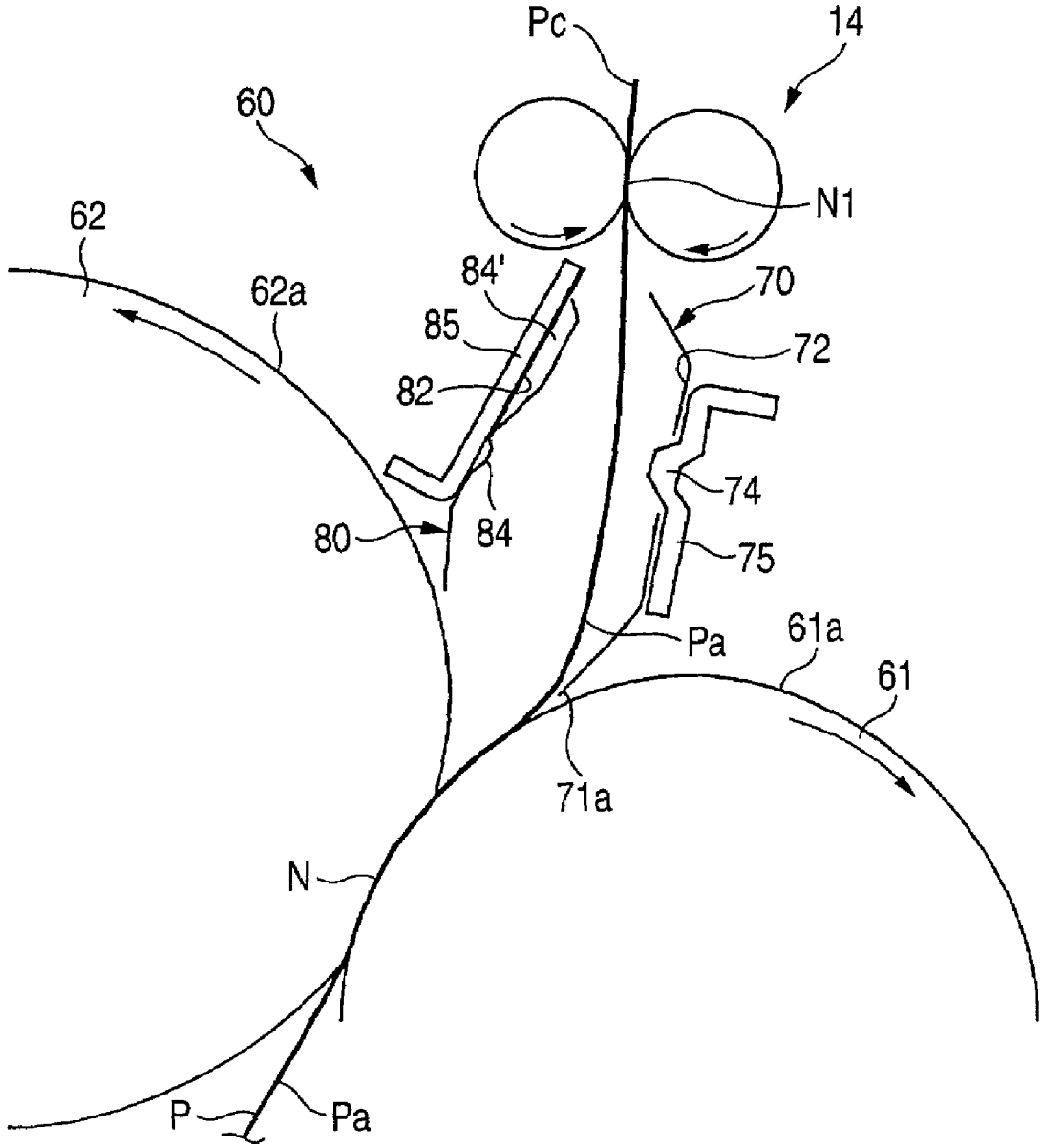

Thereafter, as shown in FIG. 26, the leading end Pc of the recording medium P is brought into the nip portion N1 of the discharge roller pair 14 and as shown in FIG. 27, the recording medium P is transported to the discharging tray 15 by the discharge roller pair 14.

Similarly, when the toner image is formed also on the back face Pb (refer to FIG. 25) of the recording medium P (case of both face printing), the back face Pb is prevented from being brought into press contact with the second guide face 82 by operation of the ribs 84 and 84' provided at the second separator 80. Further, the toner adhering face Pb is made to be difficult to be brought into press contact with also the first guide face 81 by operation of the ribs 84 and 84' for restraining the recording medium P from being bent.

Therefore, the toner adhering face Pb of the recording medium P is made to be difficult to paste on the guide faces of the second separator 80, so that paper jam is made to be difficult to be brought about.

Particularly, in the case of the oilless fixing device, even when the separators 70 and 80 are made of metal and temperature thereof is elevated by heat from the fixing member 61 and/or the pressing member 62, the toner adhering faces Pa and Pb are made to be difficult to paste thereon.

Since the rib 74 (84, 84') is provided not at the first guide face 71 (81) but at the second guide face 72 (82), the following advantages are achieved.

When the rib 74 (84, 84') is assumedly provided at the first guide face 71 (81), the rib 74 (84, 84') is liable to constitute large resistance against movement of the recording medium P. In a state where the leading end Pc of the recording medium P is guided by the first guide face 71 (81), since a free length L2 (refer to FIG. 22) of the recording medium P separated from the surface of the fixed member 61 (or the pressing member 62) is short, the rigidity of the portion of the free length L2 in the recording medium P is strong and the rib 74 (84, 84') is liable to constitute large resistance. Therefore, it is necessary to devise to reduce the height of the rib or the like, however, when the height of the rib is reduced, the toner adhering face Pa of the recording medium cannot securely be prevented from being brought into press contact with the guide faces 71, 72, 73 (81, 82).

According to the embodiment, the rib 74 (84, 84') is provided at the second guide face 72 (82) and therefore, the rib 74 (84, 84') is made to be difficult to constitute large resistance against movement of the recording medium P. In a state where the leading end Pc of the recording medium P is guided by the second guide face on the downstream side of the first guide face, a free length L3 (refer to FIG. 23) of the recording medium P separated from the surface of the fixing member is made to be long and therefore, the rigidity of the portion of the free length L3 in the recording medium P is weakened and the rib is made to be difficult to constitute large resistance. Therefore, the toner adhering face Pa of the recording medium can securely be prevented from being brought into press contact with the guide face by increasing the height of the rib.

The rib 74 of the first separator 70 is disposed on the side of the fixing roller 61 of the line connecting the outlet of the nip portion N and the inlet of the nip portion N1 (refer to imaginary line L1 of FIG. 16), the ribs 84 and 84' are disposed on the side of the pressing roller 62 of the line L1 and therefore, in a state where the recording medium P is transported to the discharging tray 15 by the discharge roller pair 14 as shown in FIG. 27, the toner face is not rubbed by the ribs 74, 84 and 84'.

The rib 74 is provided on the side of the fixing roller 61 of the line L4 connecting the upstream end 71*a* of the first separator 70 and the inlet of the nip portion N1 and therefore, when the leading end Pc of the recording medium P is separated by the upstream end 71*a* of the first separator 70 to direct to the discharge roller pair 14, the toner face Pa is made to be difficult to be rubbed by the rib 74 and the toner image is made to be difficult to be disturbed.

Further, since the guide faces 71 through 73 are constituted by a bent face and the rib 74 is provided on the side of the fixing roller 61 of the line L5 connecting the upstream end 71*a* and the downstream end 70*b*, after a state where the recording medium P is guided by the downstream end 70*b* (a state where the leading end Pc of the recording medium P passes the downstream end 70*b* from the state shown in FIG. 24), the toner face Pa is made to be difficult to be rubbed by the rib 74 and the toner image is made to be difficult to be disturbed.

Further, since the rib 74 (84, 84') is provided by projecting the rib provided on a side of a support face of the first separator 70 (80) in the support member 75 (85) from the hole 72*a* (82*a*, 82*a*') provided at the first separator 70 (80), the following advantages are achieved.

When the rib 74 (84, 84') is assumedly provided directly at the first separator 70 (80), by providing the rib 74 (84, 84'), adverse influence is liable to be effected on accuracy of the upstream edge 71*a* (81*a*) of the first separator 70 (80). For example, when the separator is constituted by a metal plate and the rib is directly formed at the separator by pressing the metal plate, influence of strain by the pressing is effected on the upstream edge 71*a* (81*a*) of the separator and the accuracy of the upstream edge 71*a* (81*a*) is liable to be deteriorated. Further, for example, when the separator with rib is integrally molded by injection molding or the like of a synthetic resin, influence of strain of the resin at a periphery of the rib portion is effected on the upstream edge 71*a* (81*a*) of the separator and the accuracy of the front end edge is liable to be deteriorated.

The upstream edge 71*a* (81*a*) of the separator is a portion brought into contact with the surface of the fixing member 61 or the like or disposed at a vicinity thereof for separating the recording medium P from the surface of the fixing member 61 or the like and therefore, when the accuracy of the upstream edge 71*a* (81*a*) is deteriorated, there is brought about a drawback that the record member P is not separated smoothly or the upstream edge 71*a* (81*a*) is brought into contact (or contact excessively) with the surface 61*a* (62*a*) of the fixing member or the like to wear the surface 61*a* (62*a*).

According to the embodiment, the rib 74 (84, 84') is provided by projecting the rib provided on the side of the support face of the first separator 70 (80) in the supporting member 75 (85) from the hole 72*a* (82*a*, 82*a'*) provided at the first separator 70 (80) and therefore, the first separator 70 (80) may only be provided with the hole 72*a* (82*a*, 82*a'*).

Therefore, the deterioration of the accuracy of the front end edge by forming the rib directly at the separator as described above can be prevented and the accuracy of the upstream edge of the separator is made to be easy to ensure.

Therefore, even when the rib 74 (84, 84') is provided, the record member P can smoothly be separated, further, also wear of the surface by bringing the upstream edge 71*a* (81*a*) into contact with the fixing member or the like excessively can be prevented.

Figure 28:
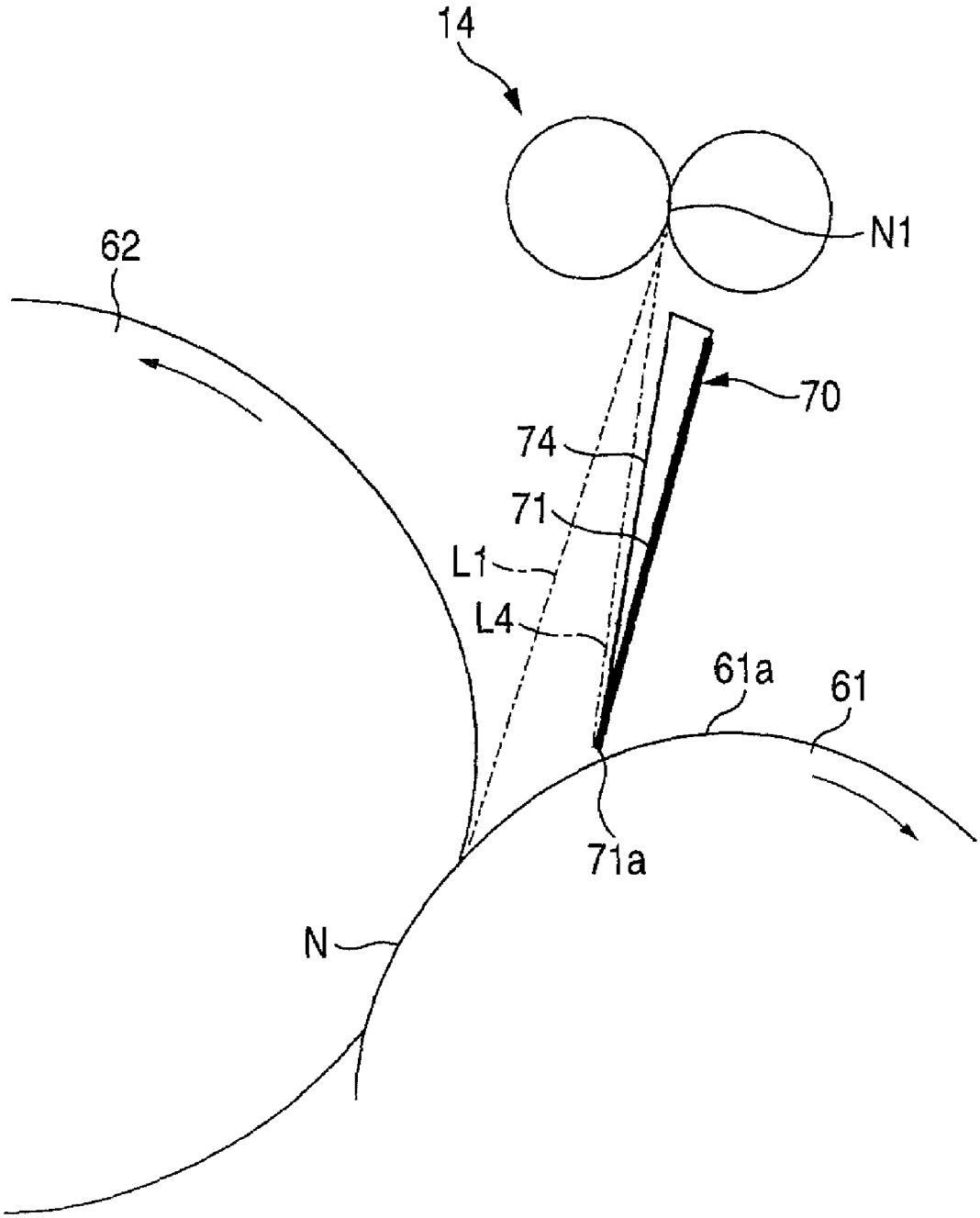
FIG. 28 is an enlarged side view showing an essential portion of a fixing device according to a third embodiment of the invention.

FIG. 28 shows a fixing device according to a third embodiment of the invention. Elements as same as those in the second embodiment are designated by the same reference numerals.

In this embodiment, the first separator 70 is constituted by a flat plate which is not bent and the rib 74 is provided at the guide face 71. Any other points are the same as those in the second embodiment.

Also in this case, pasting of the recording medium P on the guide face 71 can be prevented by the rib 74 and paper jam can be prevented from being brought about.

Further, the rib 74 is disposed on the side of the fixing roller 61 of the line L1 connecting the outlet of the nip portion N and the inlet of the nip portion N1 and therefore, when the recording medium P is transported to the discharging tray 15 by the discharge roller pair 14, the toner face is not rubbed by the rib 74.

Further, the rib 74 is provided on the side of the fixing roller 61 of the line L4 connecting the upstream end 71*a* of the first separator 70 and the inlet of the nip portion N1 and therefore, when the leading end Pc of the recording medium P is separated by the upstream end 71*a* of the first separator 70 to direct to the discharge roller pair 14, the toner face Pa is not rubbed by the rib 74 and the toner image is made to be difficult to be disturbed.

Figure 29:
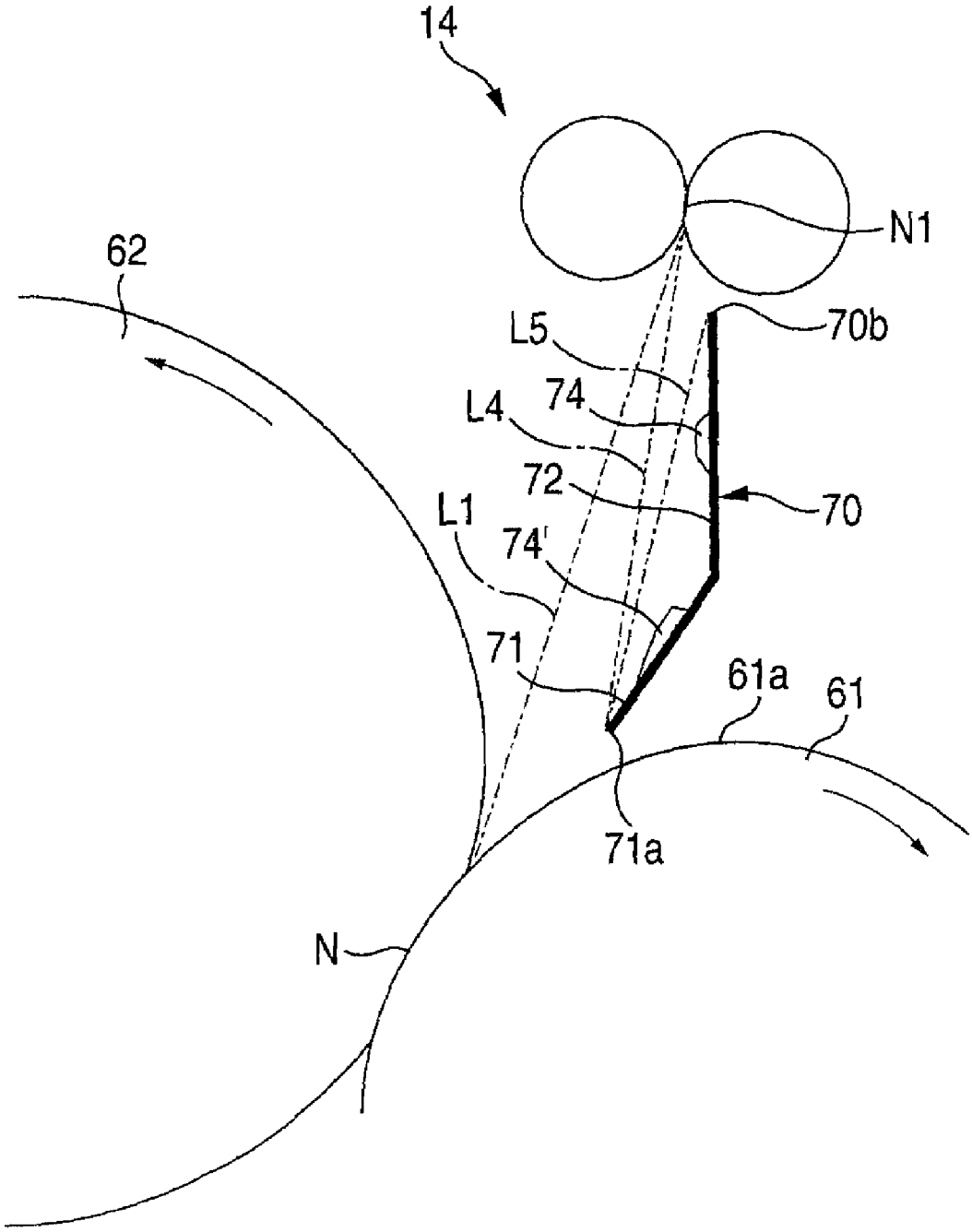
FIG. 29 is an enlarged side view showing an essential portion of a fixing device according to a fourth embodiment of the invention.

FIG. 29 shows a fixing device according to a fourth embodiment of the invention. Elements as same as those in the second embodiment are designated by the same reference numerals.

In this embodiment, the first separator 70 is constituted by a bent plate including only the first guide face 71 and the second guide face 72 which are bent (not including the third guide face 73). The first guide face 71 and the second guide face 72 are respectively provided with the ribs 74' and 74. Any other points are the same as those in the second embodiment.

Also in this case, pasting of the recording medium P on the guide faces 71 and 72 can be prevented by the ribs 74' and 74 and paper jam can be prevented from being brought about.

Further, the ribs 74' and 74 are disposed on the side of the fixing roller 61 of the line L1 connecting the outlet of the nip portion N and the nip portion N1 and therefore, when the recording medium P is transported to the discharging tray 15 by the discharge roller pair 14, the toner face is not rubbed by the ribs 74' and 74.

Further, the ribs 74' and 74 are provided on the side of the fixing roller 61 of the line L4 connecting the upstream end 71*a* of the first separator 70 and the inlet of the nip portion N1 of the discharge roller pair 14 and therefore, when the leading end Pc of the recording medium P is separated by the upstream end 71*a* of the first separator 70 to direct to the discharge roller pair 14, the toner face Pa is made to be difficult to be rubbed by the ribs 74' and 74 and the toner image is made to be difficult to be disturbed.

Further, the guide faces 71 and 72 are constituted by the bent face, the ribs 74' and 74 are provided on the side of the fixing roller 61 of the line L5 connecting the upstream end 71*a* of the guide face and the downstream end 70*b* and therefore, after the recording medium P is guided by the downstream end 70*b*, the toner face Pa is made to be difficult to be rubbed by the ribs 74' and 74 and the toner image is made to be difficult to be disturbed.

FIG. 30 shows a fixing device according to a fifth embodiment of the invention. Elements as same as those in the second embodiment are designated by the same reference numerals.

In this embodiment, the first guide face 71 and the third guide face 73 are also respectively provided with ribs 74' and 74" in addition to the rib 74 of the second guide face 72. Any other points are the same as those in the second embodiment.

Also in this case, pasting of the recording medium P on the guide faces 71 through 73 can securely be prevented by the rib 74', 74 and 74" and paper jam can further securely be prevented from being brought about.

Further, the ribs 74', 74 and 74" are disposed on the side of the fixing roller 61 of the line L1 connecting the outlet of the nip portion N and the inlet of the nip portion N1 and therefore, when a state where the recording medium P is transported to the discharging tray 15 by the discharge roller pair 14, the toner face is not rubbed by the ribs 74', 74 and 74".

Further, the ribs 74', 74 and 74" are disposed on the side of the fixing roller 61 of the line L4 connecting the upstream end 71*a* of the first separator 70 and the inlet of the nip portion N1 of the discharge roller pair 14 and therefore, when the leading end Pc of the recording medium P is separated by the upstream end 71*a* of the first separator 70 to direct to the discharge roller pair 14, the toner face Pa is made to be difficult to be rubbed by the ribs 74', 74 and 74" and the toner image is made to be difficult to be disturbed.

Further, the guide faces 71 through 73 are constituted by the bent face, the ribs 74', 74 and 74" are provided on the side of the fixing roller 61 of the line L5 connecting the upstream end 71*a* and the downstream end 70*b* and therefore, after the recording medium P is guided by the downstream end 70*b* of the guide face, the toner face Pa is made to be difficult to be rubbed by the ribs 74', 74 and 74" and the toner image is made to be difficult to be disturbed.

Figure 31A:
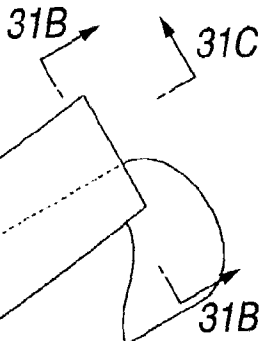
FIG. 31A is a perspective view of a fixing device according to a sixth embodiment of the invention.
Figure 31B:
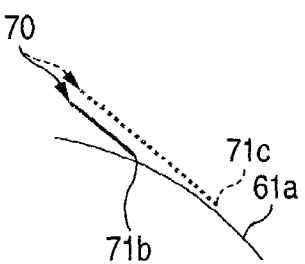
FIG. 31B is view showing sections taken along a line 31B—31B (solid line) and taken along a line 31B'—31B' (dashed line) in FIG. 31A.
Figure 31C:
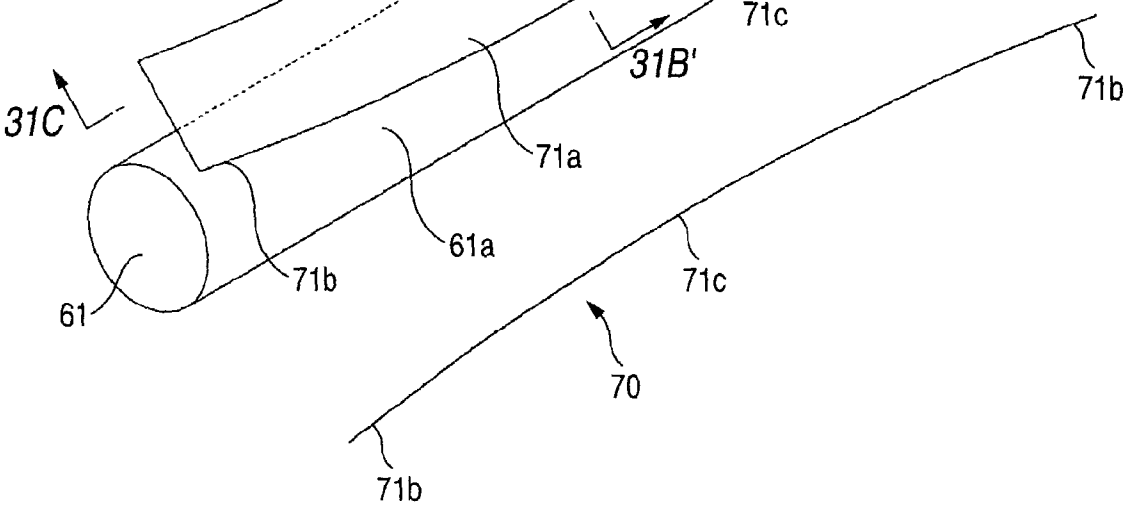
FIG. 31C is a section view taken along a line 31C—31C in FIG. 31A.

FIGS. 31A through 31C show a sixth embodiment of the invention. Elements as same as those in the above embodiments are designated by the same reference numerals.

In this embodiment, the upstream edge 71*a* of the first separator 70 is shaped so as to convex toward the upstream side of the transporting direction of the recording medium P. The diameter of the fixing roller 61 is constant entirely in the longitudinal direction thereof.

As shown in FIG. 31A and as indicated by the dashed line in FIG. 31B, a longitudinal center portion 71*c* forms a peak portion of the convex edge. Further, as shown in FIG. 31C and as indicated by the solid lines in FIG. 31B, the first separator 70 is curves such that both longitudinal end portions 71*b* of the upstream edge 71*a* are made closer to the fixing roller 61 than the longitudinal center portion 71*c*.

In these figures, the remaining parts of the first separator 70 are omitted. Any configurations explained with the above embodiments may be combined. However, the following advantages can be attained only by the part illustrated in FIG. 31A.

According to the above configuration, a central portion of a leading end of the recording medium P, which has been passed through the nip portion N of the fixing roller 61 and the pressing roller 62, is brought into contact with the central portion 71*c* of the upstream edge 71*a* of the first separator 70. Successively, the contact portion is gradually extended to the both longitudinal end portions 71*b*.

Therefore, even when the recording medium is somewhat skewed in any of left and right directions, the recording medium P is always separated from the widthwise central portion to the widthwise both end portions thereof.

Figures 34A, 34B, 34C:
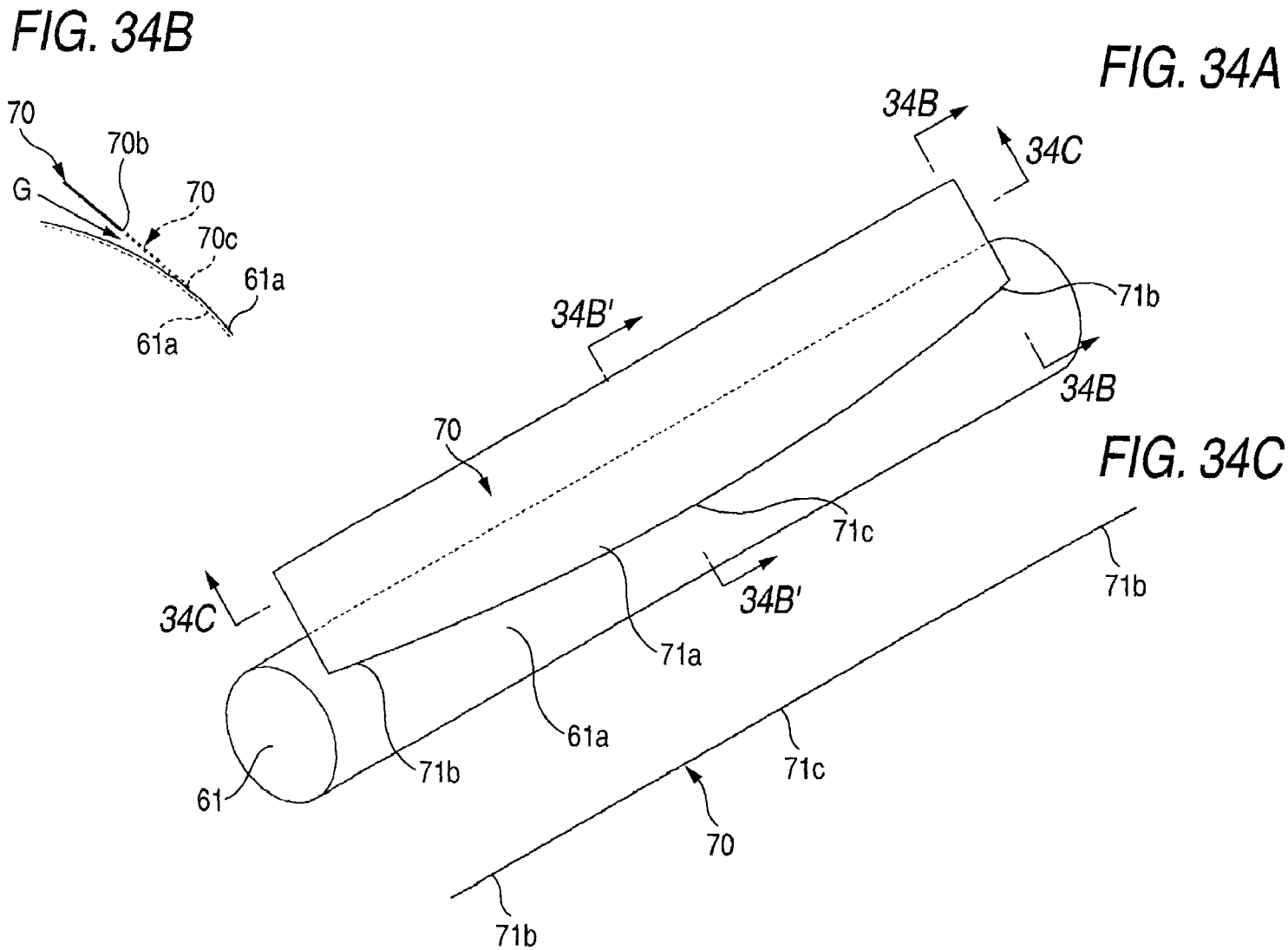
FIG. 34A is a perspective view of a fixing device according to a comparative example.
FIG. 34B is view showing sections taken along a line 34B—34B (solid line) and taken along a line 34B'—34B' (dashed line) in FIG. 34A.
FIG. 34C is a section view taken along a line 34C—34C in FIG. 34A.

FIGS. 34A through 34C shows a comparative example for the sixth embodiment, in which the upstream edge 71*a* of the first separator 70 is so shaped as to convex to the upstream side of the transporting direction of the recoding medium P (see FIG. 34A), but is so shaped as to extend linearly in the widthwise direction (see FIG. 34B). In this case, the both longitudinal end portions 71*b* of the upstream edge 71*a* is separated from the fixing roller 61 to form a gap G therebetween.

On the other hand, according to this embodiment, since the upstream edge 71*a* is so curved such that the both longitudinal end portions 71*b* are made close to the fixing roller 71, such a gap will not be formed therebetween. Accordingly, the recording medium P is always smoothly separated from the widthwise central portion to the widthwise both end portions thereof.

FIGS. 32A through 32C show a first modified example of the sixth embodiment. Here, the fixing roller 61 has an inverse crown shape (a diameter of both longitudinal end portions is larger than a diameter of a longitudinal center portion). Even in such a case, the both longitudinal end portions 71*b* of the upstream edge 71*a* are made close to the fixing roller 61 because a radius of curvature R1 of the convex edge 71*a* is smaller than a radius of curvature R2 of the fixing roller. Normally, R1 is about 1000 to 15000 mm, while R2 is about 50000 to 600000 mm.

FIGS. 33A through 33C show a second modified example of the sixth embodiment. Here, the fixing roller 61 has a crown shape (a diameter of both longitudinal end portions is smaller than a diameter of a longitudinal center portion). Also in this case, the both longitudinal end portions 71*b* of the upstream edge 71*a* are made close to the fixing roller 61.

The above configuration may be applicable to the second separator 80. In this case, the second separator 80 is curved such that both longitudinal end portion of the upstream edge thereof are made close to the pressing member 62.

FIGS. 35A through 37B shows a seventh embodiment of the invention. Elements similar to those described in the above embodiments are designated by the same reference numerals, and repetitive explanations for those will be omitted here.

Figure 35A:
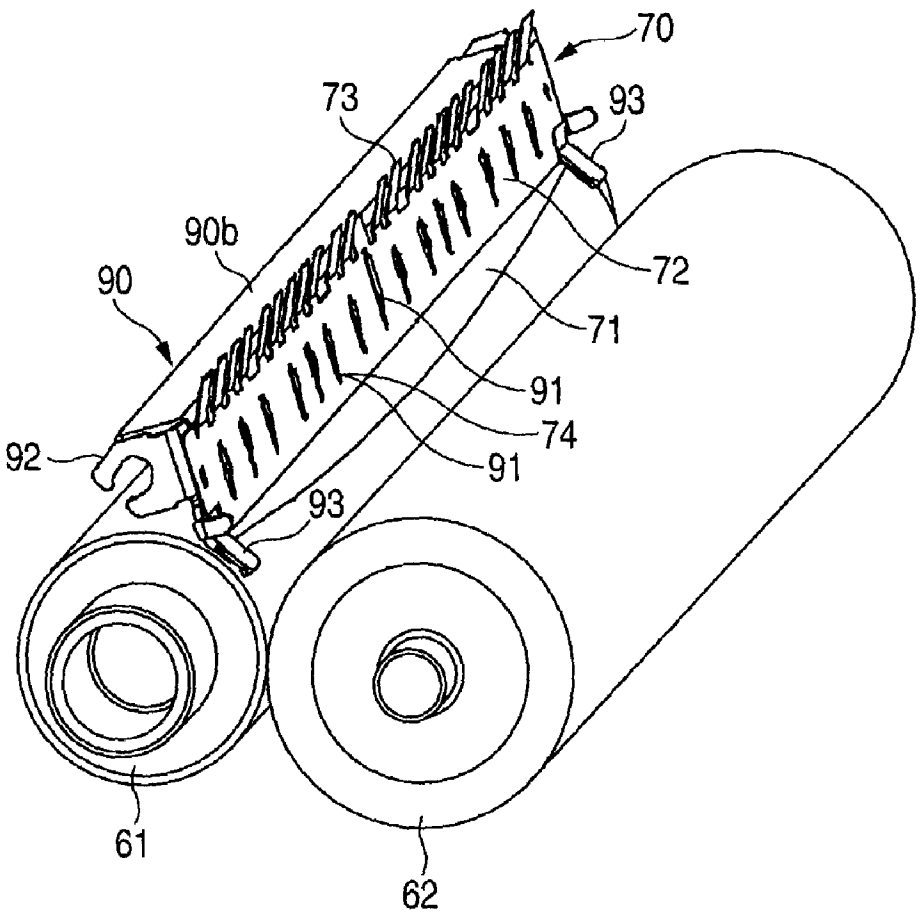
FIG. 35A is a perspective view showing a fixing device according to a seventh embodiment of the invention.
Figure 35B:
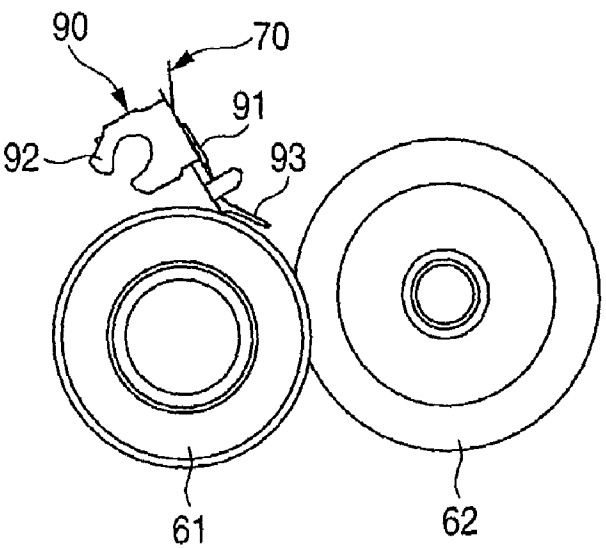
FIG. 35B is a side view of the fixing device of FIG. 35A.

In this embodiment, as shown in FIG. 35A, a first separator 70 is formed from a single metal plate (e.g., SUS301) which comprises a first guide face 71, a second guide face 72 and a fin-shaped third guide face 73. The separator 70 is supported by a supporting plate 90 having an L-shaped cross section.

Figure 37B:
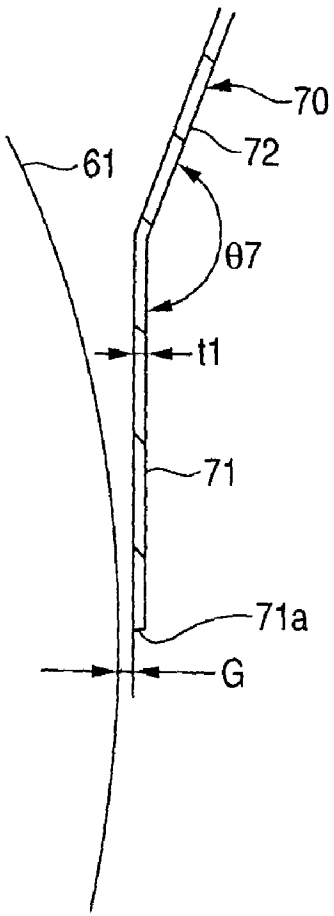
FIG. 37B is an enlarged view of the circle 37B in FIG. 37A.
Figure 37A:
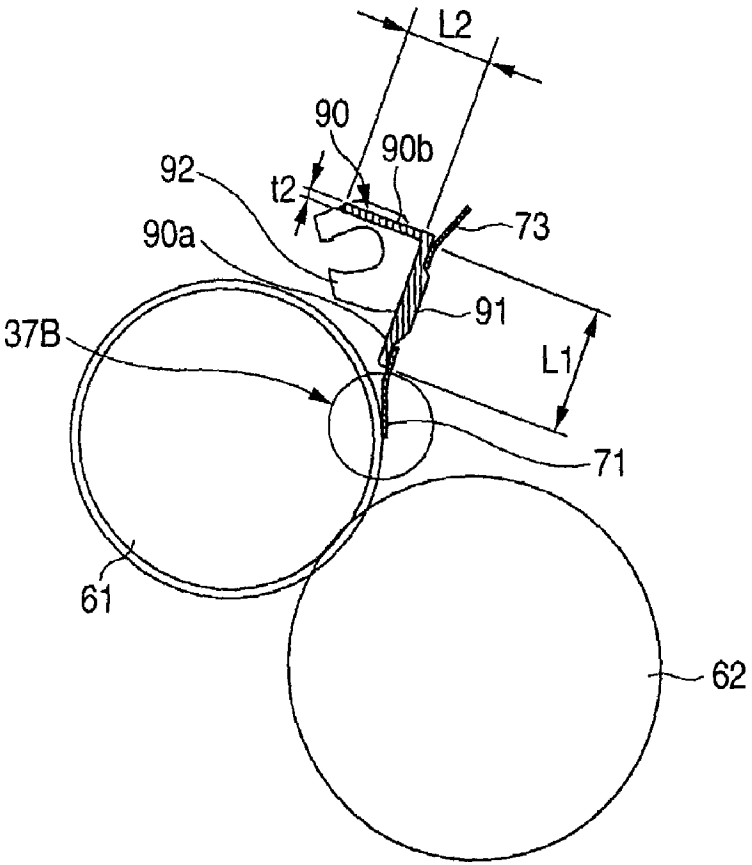
FIG. 37A is a section view taken along the line 37A—37A in FIG. 36.

The supporting plate 90 is made of a material having excellent heat conductivity such as SUS304, and is integrated with a back side of the first separator 70. As shown in FIG. 37A, the supporting plate 90 comprises a bonded portion 90*a* which is bonded with the separator 70 and a reinforcement 90*b* which reinforces the bonded portion 90*a*. The supporting plate 90 is formed with a plurality of ribs 91 (in this embodiment, fifteen ribs are provided) on a surface to be bonded with the separator 70, while the separator 70 is formed with a plurality of holes 74. The back face of the separator 70 and an obverse face of the supporting plate 90 are integrated such that each of the ribs 91 is protruded from an associated one of the holes 74. The separator 70 and the supporting plate 90 are integrated by, for example, the spot welding.

The supporting plate 90 is provided with bearing portions 92 at both longitudinal ends thereof. The separator 70 integrated with the supporting plate 90 is pivotably attached to a not-shown frame of the fixing device through the bearing portions 92. Elastic members such as torsion springs (not shown) are provided between the frame and the supporting plate 90 such that the separator 70 is urged in a clockwise direction of FIG. 37A. On the other hand, tongue pieces 93 are provided at the both longitudinal ends of the supporting plate 90 and brought into contact with the surface of a fixing roller 61 so that a gap G between an upstream edge 71*a* of the first guide face 71 and the surface of the fixing roller 61 are properly regulated. The gap G falls within a range from 0.15 mm to 0.25 mm.

Figure 36:
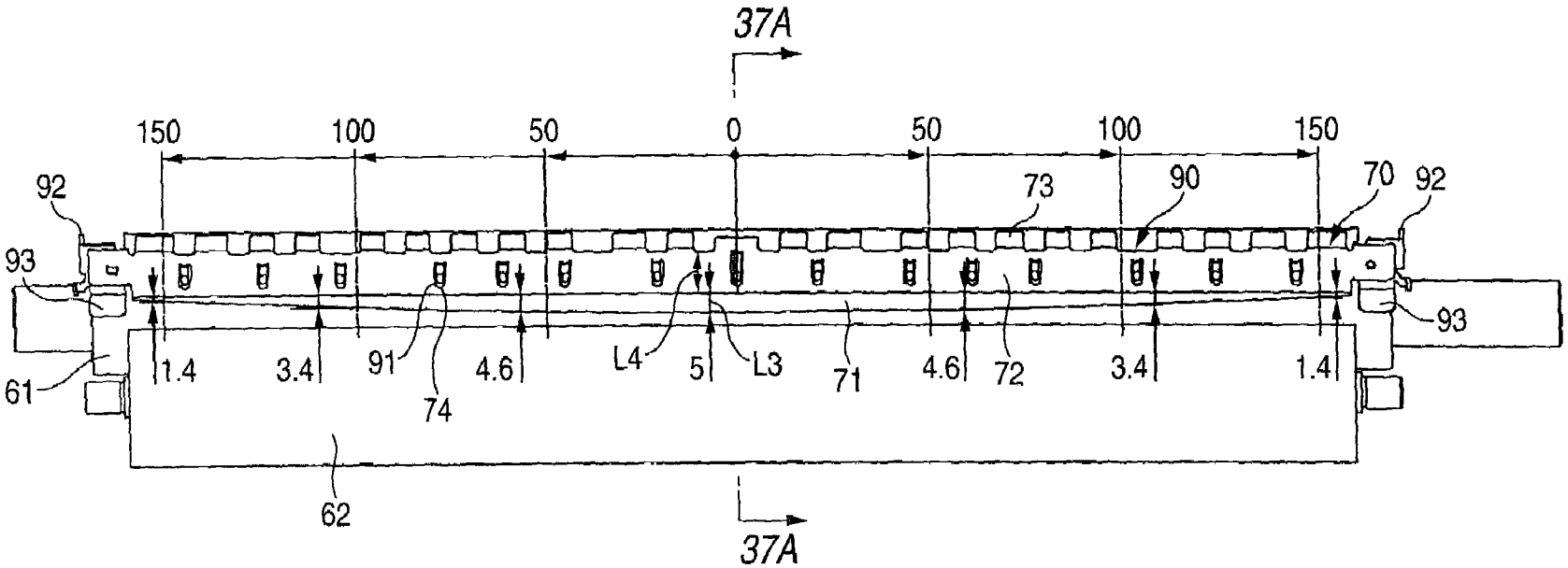
FIG. 36 is a plan view of the fixing device of FIG. 35A.

FIG. 36 is a plan view of the separator 70 showing detailed dimensions of essential parts thereof. The unit of each numeral is mm. In FIG. 37A, L1 is 11.9 mm and L2 is 8 mm. In FIG. 37B, the angle θ7 between the first guide face 71 and the second guide face 72 falls within a range from 160 degrees to 170 degrees. In a case where the angle θ7 is less than 160 degrees, the leading end of the recording medium fed through the first guide face 71 strongly collides with the second guide face 72. On the other hand, in a case where the angle θ7 is more than 170 degrees, the surface of the recoding medium on which the toner image is formed is liable to be adhered onto the first guide face 71 or the second guide face 72.

Upon activation of the fixing device, a heating element starts to heat the fixing roller 61, thereby the separator 70 and the supporting plate 90 are also heated due to the heat from the fixing roller 61. In a condition that all of the fixing roller 61, the separator 70 and the supporting plate 90 are sufficiently heated, the gap G falls within the above described proper range.

At this occasion, the first guide face 71 of the separator 70 in the close proximity of the fixing roller 61 is first heated rapidly, and the supporting plate 90 is subsequently heated. Accordingly, during the heating process of the heating roller 61, temperature difference is generated between the separator 70 and the supporting plate 90.

In a case where the recording medium is fed to the fixing device after the fixing roller 61 is sufficiently heated but there is still the above temperature difference, the gap becomes larger than the above proper range due to the bimetal effect of the separator 70 and the supporting plate 90. As a result, the recording medium would not be properly separated from the fixing roller 61, so that the jamming would be occurred.

In order to avoid the above problem, in this embodiment, the dimensions shown in FIGS. 36 and 37A are determined as follows.

In a case where the length of the first guide face 71 is Defined as L3, and the length of the second guide face 72 is defined as L4, they are determined so as to satisfy $L3/L4<1/3$.

In a case where the thickness of the separator 70 is defined as t1, and the thickness of the supporting plate 90 is defined as t2, they are determined so as to satisfy $t1/t2 \leqq 0.2$. Specifically, t1 is 0.15 mm, and t2 is 1 mm.

In a case where the length of the bonded portion 90*a* is defined as L1, and the length of the reinforcement 90*b* is defined as L2, they are determined so as to satisfy L2/L1≧0.5.

Although an explanation has been given of the embodiment of the invention as described above, the invention is not limited to the above-described embodiment but can pertinently be modified within the range of the gist of the invention. For example, the invention is applicable even when the fixing member 61 is a belt-shaped member.

What is claimed is:

1. A fixing device, adapted to be incorporated in an image forming apparatus and operable to fix a toner image on a recording medium, the fixing device comprising:

a first rotative member and a second rotative member, forming a nip portion therebetween, at which the toner image is fixed on the recording medium; and a separator, having a first portion adapted to separate the recording medium, which has been passed through the nip portion, from one of the first rotative member and the second rotative member, the separator extending in a first direction which is perpendicular to a transporting direction of the recording medium, wherein:

the first portion is convex toward an upstream side of the transporting direction; and the separator is curved such that both end portions thereof in the first direction are made closer to one of the first rotative member and the second rotative member than a center portion thereof in the first direction.

2. The fixing device as set forth in claim 1, wherein:

the separator comprises a second portion continued from the first portion and including a plurality of sections each of which extends in a direction different from each other, and each of which is adapted to guide the recording medium to an inlet of a subsequent stage of the image forming apparatus; and a downstream end of the second portion relative to the transporting direction of the recording medium is disposed in the vicinity of the inlet.

* * * * *